US007500874B2

(12) United States Patent
Montena

(10) Patent No.: US 7,500,874 B2
(45) Date of Patent: Mar. 10, 2009

(54) NUT SEAL ASSEMBLY FOR COAXIAL CABLE SYSTEM COMPONENTS

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/441,623

(22) Filed: May 26, 2006

(65) Prior Publication Data

US 2006/0216990 A1 Sep. 28, 2006

Related U.S. Application Data

(63) Continuation-in-part of application No. 11/095,316, filed on Mar. 31, 2005, now Pat. No. 7,097,500, which is a continuation-in-part of application No. 10/876,386, filed on Jun. 25, 2004, now Pat. No. 7,186,127.

(51) Int. Cl.
*H01R 9/05* (2006.01)

(52) U.S. Cl. ..... 439/587

(58) Field of Classification Search ..... 439/578–585, 439/277, 273, 587, 620; 174/65 SS; 277/622; 403/24, 203

See application file for complete search history.

(56) References Cited

U.S. PATENT DOCUMENTS 3,328,746 A 6/1967 Schumacher
3,449,706 A 6/1969 Carissimi (Continued)

FOREIGN PATENT DOCUMENTS

DE 198 36 137 3/2000

(Continued)

OTHER PUBLICATIONS

U.S. Appl. No. 11/322,097, filed Dec. 29, 2005, Montena.

*Primary Examiner*—Alexander Gilman
(74) *Attorney, Agent, or Firm*—Marjama Muldoon Blasiak & Sullivan, LLP

(57) ABSTRACT

An integrated seal assembly and a coaxial cable system component incorporating the seal assembly with a connector for coupling to an externally threaded port. The seal assembly includes a bellows-type seal having an elastically deformable tubular body and a plurality of sealing surfaces, and an integral joint-section intermediate an anterior end and a posterior end that assists in the axial deformation of the seal in response to axially-directed force. One of the sealing surfaces is made to engage a corresponding surface of an internally threaded nut or housing. The component is engagable with an externally threaded port via the internally threaded connector. The anterior end of the seal fits over the port and a sealing surface of the seal is capable of sealing axially against a shoulder of the port while the seal body covers the otherwise exposed externally threaded port. Upon tightening of the nut on the port, the seal deflects in the axial direction to accommodate a variety of distances between the connector and the shoulder of the port. Additionally, the seal is capable of expanding to allow a second sealing surface to contact and seal against a variety of smooth outside diameters of the port. The versatility of the seal allows an operator to use one connector of a system component on a wide variety of externally threaded ports without the risk of a faulty seal at the connection or a poor connection due to an improper seal.

12 Claims, 26 Drawing Sheets

U.S. PATENT DOCUMENTS

| | | | | | |
|---|---|---|---|---|---|
| 3,520,342 | A | | 7/1970 | Scheffer | |
| 3,530,425 | A | | 9/1970 | Vachhani | |
| 3,668,612 | A | | 6/1972 | Nepovim | |
| 3,710,005 | A | * | 1/1973 | French | 174/89 |
| 3,910,673 | A | | 10/1975 | Stokes | |
| 4,046,451 | A | | 9/1977 | Juds et al. | |
| 4,126,170 | A | | 11/1978 | DeHaitre | |
| 4,138,198 | A | | 2/1979 | Brown | |
| 4,173,385 | A | | 11/1979 | Fenn et al. | |
| 4,296,950 | A | | 10/1981 | Chamberlin | |
| 4,367,060 | A | | 1/1983 | Berecz | |
| 4,433,889 | A | | 2/1984 | Ratchford et al. | |
| 4,447,103 | A | | 5/1984 | Werth et al. | |
| 4,659,272 | A | | 4/1987 | Pratt | |
| 4,674,818 | A | | 6/1987 | McMills et al. | |
| 4,717,355 | A | | 1/1988 | Mattis | |
| 4,824,400 | A | | 4/1989 | Spinner | |
| 4,834,675 | A | | 5/1989 | Samchisen | |
| 4,857,007 | A | | 8/1989 | Michaels et al. | |
| 4,869,679 | A | * | 9/1989 | Szegda | 439/272 |
| 4,902,246 | A | | 2/1990 | Samchisen | |
| 4,907,924 | A | | 3/1990 | Hellon | |
| 4,960,342 | A | | 10/1990 | Chi | |
| 4,961,713 | A | | 10/1990 | McCracken et al. | |
| 5,011,432 | A | | 4/1991 | Sucht et al. | |
| 5,127,853 | A | | 7/1992 | McMills et al. | |
| 5,273,444 | A | * | 12/1993 | Down et al. | 439/133 |
| 5,278,525 | A | | 1/1994 | Palinkas | |
| 5,283,853 | A | | 2/1994 | Szegda | |
| 5,284,449 | A | | 2/1994 | Vaccaro | |
| 5,322,454 | A | | 6/1994 | Thommen | |
| 5,342,096 | A | | 8/1994 | Bachle et al. | |
| 5,435,745 | A | | 7/1995 | Booth | |
| 5,454,675 | A | | 10/1995 | DeHaitre | |
| 5,561,900 | A | | 10/1996 | Hosler, Sr. | |
| 5,571,028 | A | | 11/1996 | Szegda | |
| 5,651,698 | A | | 7/1997 | Locati et al. | |
| 5,662,489 | A | | 9/1997 | Stirling | |
| 5,681,189 | A | * | 10/1997 | Dunham | 439/738 |
| 5,766,037 | A | | 6/1998 | Nelson | |
| 5,795,188 | A | | 8/1998 | Harwath | |
| 5,857,865 | A | * | 1/1999 | Shimirak et al. | 439/277 |
| 5,866,849 | A | * | 2/1999 | Tuvy et al. | 174/74 A |
| 5,938,474 | A | | 8/1999 | Nelson | |
| 5,980,315 | A | | 11/1999 | Matsuda et al. | |
| 5,984,723 | A | | 11/1999 | Wild | |
| 5,993,254 | A | | 11/1999 | Pitschi et al. | |
| 6,019,636 | A | | 2/2000 | Langham | |
| 6,032,358 | A | | 3/2000 | Wild | |
| 6,053,749 | A | | 4/2000 | Masuda et al. | |
| 6,102,737 | A | | 8/2000 | Gohdes | |
| 6,234,838 | B1 | | 5/2001 | Wong | |
| 6,261,125 | B1 | * | 7/2001 | Yeh | 439/579 |
| 6,298,190 | B2 | | 10/2001 | Waldron et al. | |
| 6,471,545 | B1 | | 10/2002 | Hosler, Sr. | |
| 6,476,688 | B2 | * | 11/2002 | Palinkas | 333/175 |
| 6,491,546 | B1 | | 12/2002 | Perry | |
| 6,592,403 | B2 | | 7/2003 | Kooiman | |
| 6,692,300 | B2 | | 2/2004 | Kanda et al. | |
| 6,884,113 | B1 | | 4/2005 | Montena | |
| 6,929,265 | B2 | * | 8/2005 | Holland et al. | 277/622 |
| 2002/0057140 | A1 | * | 5/2002 | Palinkas | 333/185 |
| 2004/0029443 | A1 | | 2/2004 | Quadir et al. | |

FOREIGN PATENT DOCUMENTS

| | | |
|---|---|---|
| EP | 0 252 601 | 1/1988 |

* cited by examiner

NUT SEAL ASSEMBLY FOR COAXIAL CABLE SYSTEM COMPONENTS

CROSS REFERENCE TO RELATED APPLICATION

This application is a continuation in part of U.S. Ser. No. 11/095,316 filed Mar. 31, 2005, now U.S. Pat. No. 7,097,500, which is a continuation in part of U.S. Ser. No. 10/876,386 filed Jun. 25, 2004, now U.S. Pat. No. 7,186,127.

FIELD OF THE INVENTION

Embodiments of the invention relate generally to data transmission system components, and more particularly to a nut seal assembly for use with a connector of a coaxial cable system component for sealing a threaded port connection, and to a coaxial cable system component incorporating the seal assembly.

BACKGROUND OF THE INVENTION

Community antenna television (CATV) systems and many broadband data transmission systems rely on a network of coaxial cables to carry a wide range of radio frequency (RF) transmissions with low amounts of loss and distortion. A covering of plastic or rubber adequately seals an uncut length of coaxial cable from environmental elements such as water, salt, oil, dirt, etc. However, the cable must attach to other cables, components and/or to equipment (e.g., taps, filters, splitters and terminators) generally having threaded ports (hereinafter, "ports") for distributing or otherwise utilizing the signals carried by the coaxial cable. A service technician or other operator must frequently cut and prepare the end of a length of coaxial cable, attach the cable to a coaxial cable connector, or a connector incorporated in a coaxial cable system component, and install the connector on a threaded port. This is typically done in the field. Environmentally exposed (usually threaded) parts of the components and ports are susceptible to corrosion and contamination from environmental elements and other sources, as the connections are typically located outdoors, at taps on telephone polls, on customer premises, or in underground vaults. These environmental elements eventually corrode the electrical connections located in the connector and between the connector and mating components. The resulting corrosion reduces the efficiency of the affected connection, which reduces the signal quality of the RF transmission through the connector. Corrosion in the immediate vicinity of the connector-port connection is often the source of service attention, resulting in high maintenance costs.

Numerous methods and devices have been used to improve the moisture and corrosion resistance of connectors and connections. These include, for example, wrapping the connector with electrical tape, enclosing the connector within a flexible boot which is slid over the connector from the cable, applying a shrink wrapping to the connector, coating the connector with plastic or rubber cement, and employing tubular grommets of the type discussed in U.S. Pat. No. 4,674,818 (McMills, et al.) and in U.S. Pat. No. 4,869,679 (Szegda), for example.

Although these methods work, more or less, if properly executed, they all require a particular combination of skill, patience, and attention to detail on the part of the technician or operator. For instance, it may be difficult to apply electrical tape to an assembled connection when the connection is located in a small, enclosed area. Shrink wrapping may be an improvement under certain conditions, but shrink wrap application typically requires applied heat or chemicals, which may be unavailable or dangerous. Rubber-based cements eliminate the need for heat, but the connection must be clean and the cement applied somewhat uniformly. These otherwise attainable conditions may be complicated by cold temperatures, confined or dirty locations, etc. Operators may require additional training and vigilance to seal coaxial cable connections using rubber grommets or seals. An operator must first choose the appropriate seal for the application and then remember to place the seal onto one of the connective members prior to assembling the connection. Certain rubber seal designs seal only through radial compression. These seals must be tight enough to collapse onto or around the mating parts. Because there may be several diameters over which the seal must extend, the seal is likely to be very tight on at least one of the diameters. High friction caused by the tight seal may lead an operator to believe that the assembled connection is completely tightened when it actually remains loose. A loose connection may not efficiently transfer a quality RF signal causing problems similar to corrosion.

Other seal designs require axial compression generated between the connector nut and an opposing surface of the port. An appropriate length seal that sufficiently spans the distance between the nut and the opposing surface, without being too long, must be selected. If the seal is too long, the seal may prevent complete assembly of the connector or component. If the seal is too short, moisture freely passes. The selection is made more complicated because port lengths may vary among different manufacturers.

In view of the aforementioned shortcomings and others known by those skilled in the art, the inventor has recognized a need for a seal and a sealing connector that addresses these shortcomings and provides other advantages and efficiencies.

SUMMARY OF THE INVENTION

Embodiments of the invention are directed to a seal assembly and to various coaxial cable system components, including but not limited to connectors, filters, and terminators, which incorporate a seal assembly in accordance with the described embodiments.

An embodiment of the invention is directed to a seal assembly for use with a connector. An intended function of the seal assembly is to prevent the ingress of moisture and contaminants, and the detrimental effects of environmental changes in pressure and temperature on a coaxial cable connection. In an exemplary embodiment, a seal assembly includes a nut component and a bellows-type elastomer seal having an elastically deformable tubular body attached to the nut component, wherein the seal and nut form an integrated seal assembly. In an aspect, the nut component has an interior surface at least a portion of which is threaded, a connector-grasping portion, and a seal-grasping surface portion. The seal-grasping surface portion may be on either the interior or exterior surface of the nut component. In an aspect, at least part of the seal-grasping portion is a smooth surface or a roughened surface suitable to frictionally engage a rear sealing surface of the seal. In an aspect, at least part of the seal-grasping portion is a surface suitable to adhesively engage the rear sealing surface of the seal. In an alternative embodiment, the nut component further includes a nut-turning surface portion along an external perimeter surface of the nut component. In an aspect, the nut-turning surface portion can have at least two flat surface regions suitable for engagement with the jaws of a tool. In an aspect, the nut-turning surface portion is a knurled surface, which lends itself to manual manipulation.

According to an aspect, the seal consists of an elastically deformable tubular body having a forward sealing surface, a rear sealing portion including an sealing surface that integrally engages the nut component, and an integral joint-section intermediate an anterior end and a posterior end of the tubular body, wherein, upon axial compression of the tubular body, the tubular body is adapted to expand radially at the integral joint-section. According to various aspects, the seal is made of a compression molded, elastomer material. In one aspect, the material is a silicone rubber material. In another aspect, the material is a propylene material. Other suitable elastomers are available.

In an alternative embodiment, the seal assembly further comprises a seal ring having an inner surface and an outer surface, wherein the inner surface has a diameter such that the seal ring is press-fit against an exterior surface of the rear sealing portion of the seal. In an aspect, the seal ring has an outwardly extending flange along a posterior perimeter of the seal ring. In an aspect, the outer surface of the seal ring is knurled.

Another embodiment of the invention is directed to a connector for connecting a coaxial cable to a port. According to an exemplary embodiment, the connector includes a tubular connector body, means for attaching the first end of the connector body to the coaxial cable, and a seal assembly. In an aspect, the seal assembly is the seal assembly in its various aspects described herein above and in the detailed description that follows. An exemplary connector is an F-connector.

A further embodiment of the invention is directed toward a seal assembly for use with a termination device to seal and terminate the unused output ports. Termination devices are used by to match the impedance of the coaxial cables, and to prevent theft of the cable signal by non-subscribers who could otherwise simply attach a coaxial cable themselves to any vacant output port. An example of such a termination device is described in U.S. Pat. No. 6,491,546 to Perry, the disclosure of which is incorporated by reference herein. According to an exemplary embodiment, the invention comprises a housing having internal threads at one end for connection to a port and a seal assembly. The termination device may also include a resistor within the housing. The housing at the threaded end of the termination device includes a seal-grasping, cylindrical surface for the mating of the seal. In an aspect, the seal assembly is, in its various aspects, described herein above and in the detailed description that follows.

An alternative embodiment of the invention is directed toward a seal assembly for a tamper-resistant termination device. The tamper-resistant termination device includes a housing, an outer shell and a seal assembly. One end of the housing includes internal threads for connection to the unused threaded port and a seal-grasping, cylindrical outer surface. The outer shell surrounds and rotates independently about the housing. One end of the outer shell includes an opening for the insertion of a specialized tool for mating with the housing to selectively install or remove the housing from the threaded port. In an aspect, the baffle-type elastomer seal described above is seated in a groove on the cylindrical outer surface of the housing. The outer shell at least partial covers the end of the seal and assists in retaining the seal in place.

Yet another embodiment of the invention is directed toward a seal assembly for use with a filter or trap. Filters are used in coaxial cable systems for selectively removing or attenuating signals at particular frequencies so that the selected signals will not reach a subscriber's location in a usable form. An example of such a filter or trap for use in a cable system is disclosed in U.S. Pat. No. 5,278,525 to Palinkas, the disclosure of which is incorporated herein by reference. According an exemplary embodiment, the invention comprises a filter housing which contains the filtering components, male and female connectors at respective ends of the housing, and a seal assembly. In an aspect, the seal assembly is the seal assembly in its various aspects described herein above and in the detailed description that follows.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1A:
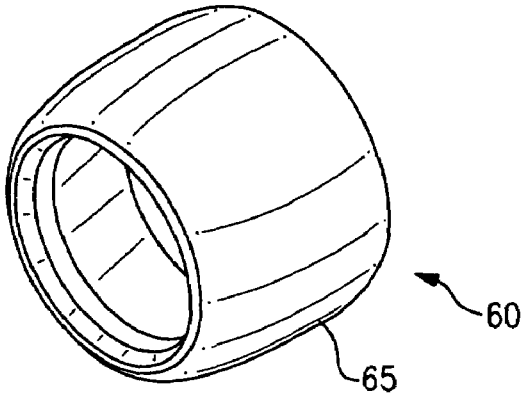
FIGS. 1A, B, C represent a specification drawing of a seal according to an exemplary embodiment of the invention.
Figure 1B:
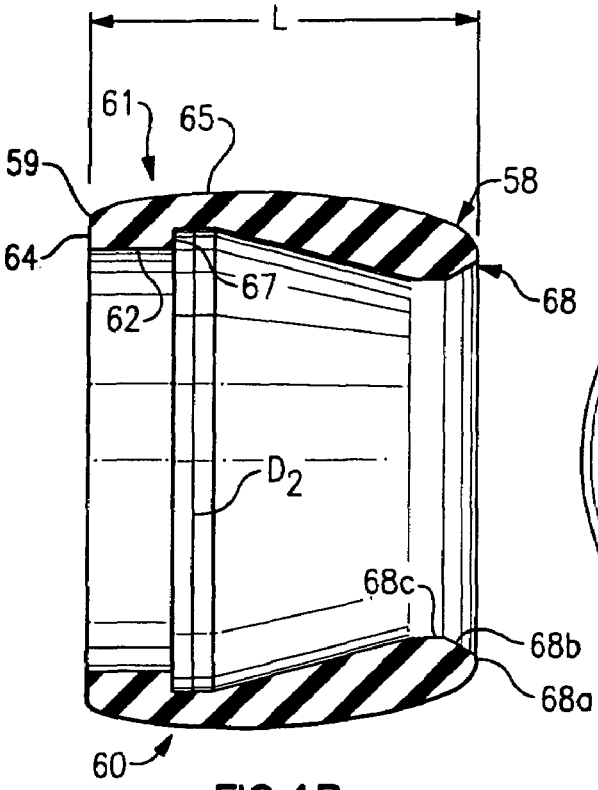
Figure 1C:
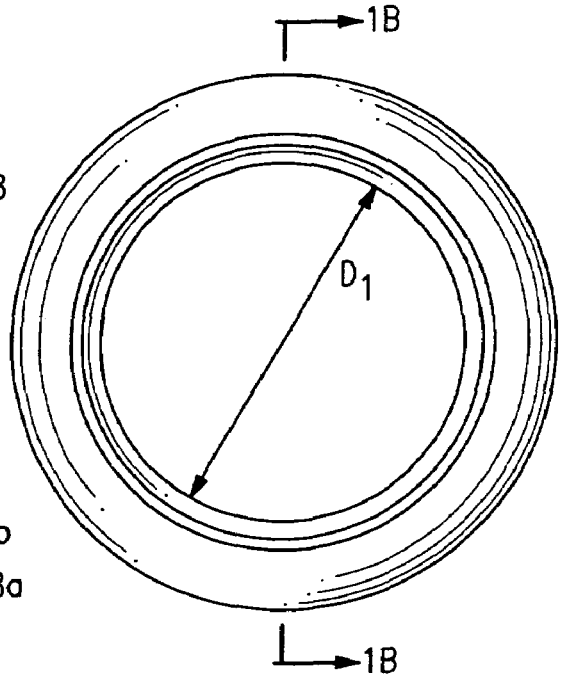

Embodiments of the invention are directed to a seal assembly for use with a coaxial cable system component and to a coaxial cable system component including a seal assembly in accordance with the described embodiments. Throughout the description, like reference numerals will refer to like parts in the various drawing figures.

For ease of description, the coaxial cable system components such as connectors, termination devices, filters and the like, referred to and illustrated herein will be of a type and form suited for connecting a coaxial cable or component, used for CATV or other data transmission, to an externally threaded port having a ⅜ inch -32 UNEF 2A thread. Those skilled in the art will appreciate, however, that many system components include a rotatable, internally threaded nut that attaches the component to a typical externally threaded port, the specific size, shape and component details may vary in ways that do not impact the invention per se, and which are not part of the invention per se. Likewise, the externally threaded portion of the port may vary in dimension (diameter and length) and configuration. For example, a port may be referred to as a "short" port where the connecting portion has a length of about 0.325 inches. A "long" port may have a connecting length of about 0.500 inches. All of the connecting portion of the port may be threaded, or there may be an unthreaded shoulder immediately adjacent the threaded portion, for example. In all cases, the component and port must cooperatively engage. According to the embodiments of the present invention, a sealing relationship is provided for the otherwise exposed region between the component connector and the externally threaded portion of the port.

Figure 2:
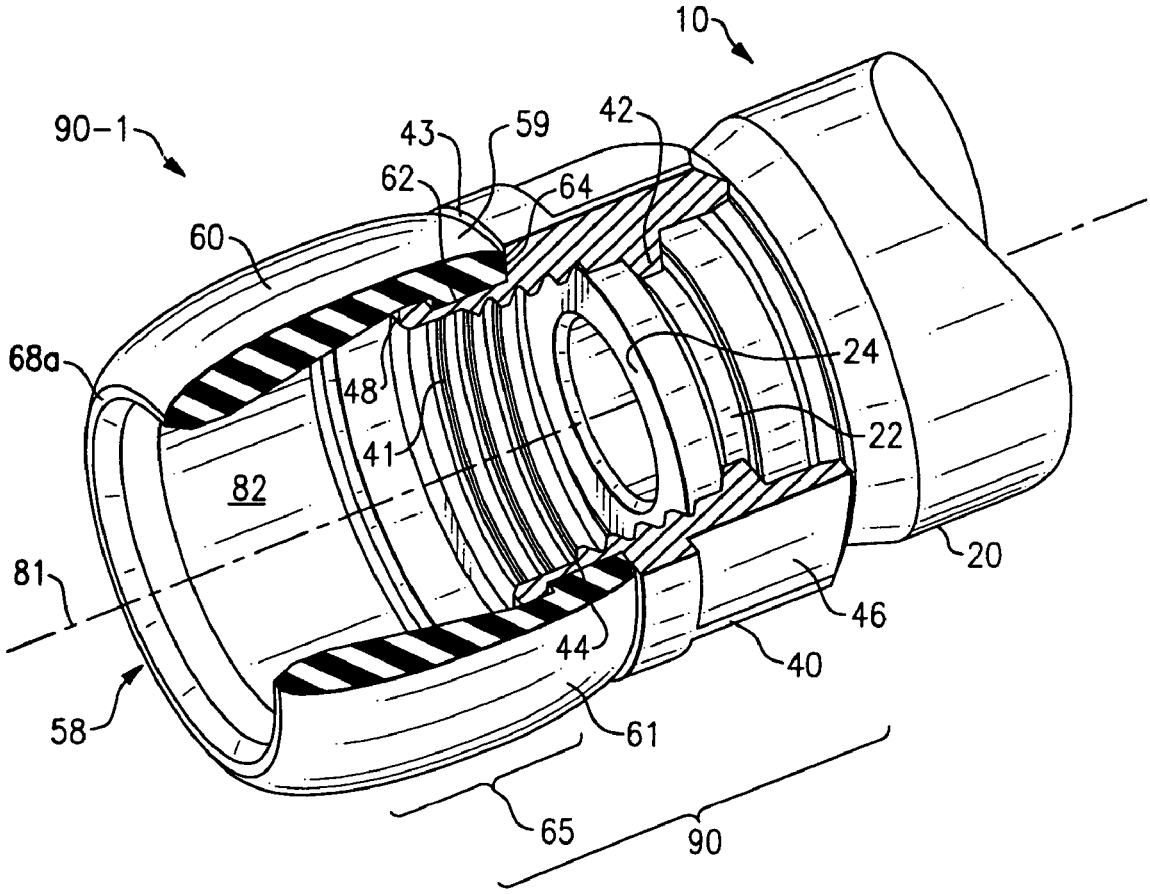
FIG. 2 is an enlarged partially sectioned perspective view of a seal assembly portion of the connector shown in FIG. 1.

A preferred embodiment of the invention is directed to a seal assembly 90 for use with a coaxial connector, exemplary aspects of which are illustrated in FIGS. 2-5. As shown, the coaxial connector 10 is disposed around an axis of rotation 81 that intersects a cavity 82 formed by the seal 60. In a general aspect 90-1 illustrated in FIGS. 2 and 3, the seal assembly 90 includes a seal 60 and a nut component 40. The seal and the nut component form an integral assembly as illustrated in FIG. 2.

An exemplary seal 60 is illustrated in FIGS. 1A, 1B, 1C, and FIG. 2. The seal 60 has a generally tubular body that is elastically deformable by nature of its material characteristics and design. In general, the seal 60 is a one-piece element made of a compression molded, elastomer material having suitable chemical resistance and material stability (i.e., elasticity) over a temperature range between about −40° C. to +40° C. A typical material can be, for example, silicone rubber. Alternatively, the material may be propylene, a typical O-ring material. Other materials known in the art may also be suitable. The interested reader is referred to http://www.applerubber.com for an exemplary listing of potentially suitable seal materials.

The body of seal 60 has an anterior end 58 and a posterior end 59, the anterior end being a free end for ultimate engagement with a port, while the posterior end is for ultimate connection to the nut component 40 of the seal assembly. The seal has a forward sealing surface 68, a rear sealing portion 61 including an interior sealing surface 62, also referred to as a nut grasping surface 62, that integrally engages the nut component (described in greater detail below), and an intermediate section 65 intermediate the anterior end 58 and the posterior end 59 of the tubular body. The forward sealing surface 68 at the anterior end of the seal 60 may include annular facets 68*a*, 68*b* and 68*c* to assist in forming a seal with the port.

Alternatively, forward sealing surface 68 may be a continuous rounded annular surface that forms effective seals through the elastic deformation of the internal surface and end of the seal compressed against the port. The integral joint-section includes a portion of the length of the seal which is relatively thinner in radial cross-section to encourage an outward expansion or bowing of the seal upon its axial compression. In the exemplary embodiment, the nut grasping surface includes an interior sealing surface 62 which forms an annular surface on the inside of the tubular body, and an internal shoulder 67 of the tubular body adjacent the posterior end 59, as illustrated in FIG. 11B.

In its intended use, compressive axial force may be applied against one or both ends of the seal depending upon the length of the port intended to be sealed. The force will act to axially compress the seal whereupon it will expand radially in the vicinity of the intermediate section 65. In an aspect, the intermediate section 65 is located axially asymmetrically intermediate the anterior end 58 and the posterior end 59 of the tubular body, and adjacent an anterior end 62' of the interior sealing surface 62, as illustrated.

In a preferred embodiment, the tubular body has an interior diameter, D2, at the intermediate section 65 equal to about 0.44 inches in an uncompressed state. The tubular body has a length, L, from the anterior end 58 to the posterior end 59 of about 0.36 inches in an uncompressed state. However, it is contemplated that the joint-section 65 can be designed to be inserted anywhere between the interior sealing surface 62 and anterior end 58. The seal is designed to prevent the ingress of corrosive elements when the seal is used for its intended function.

Figure 3:
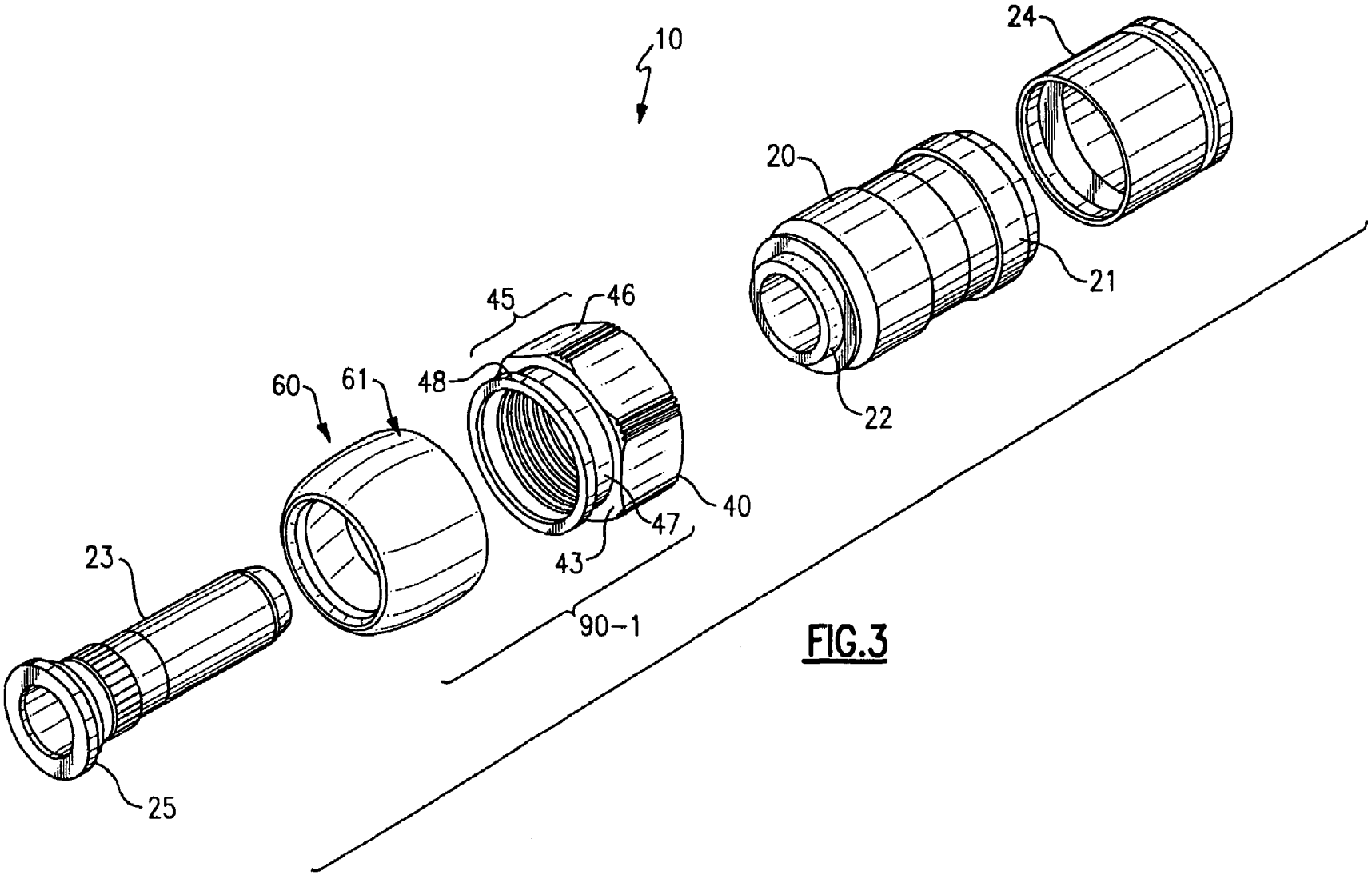
FIG. 3 is an exploded perspective view of a connector according to an exemplary embodiment of the invention.

The nut component 40 of the seal assembly 90, illustrated by example in FIGS. 2 and 3, has an interior surface, at least a portion 41 of which is threaded, a connector-grasping portion 42, and an exterior surface 45 including a seal-grasping surface portion 47. In an aspect, the seal-grasping surface 47 can be a flat, smooth surface or a flat, roughened surface suitable to frictionally and/or adhesively engage the interior sealing surface 62 of the seal 60. In an exemplary aspect, the seal-grasping surface 47 may also contain a ridge 48 that together with the seal grasping surface forms a groove or shoulder that is suitably sized and shaped to correspondingly engage the internal shoulder 67 of the seal adjacent the interior sealing surface 62 in a locking-type interference fit between the nut component 40 and the seal 60 as illustrated in FIG. 2.

The exemplary nut component 40 further includes a nut-turning surface portion 46 on surface 45. In the exemplary aspect shown in FIG. 3, the nut-turning surface portion 46 has at least two flat surface regions that allow engagement with the surfaces of a tool such as a wrench. Typically, the nut-turning surface in this aspect will be hexagonal. Alternatively, the nut turning surface may be a knurled surface to facilitate hand-turning of the nut component. Upon engagement of the seal with the nut component, a posterior sealing surface 64 of the seal abuts a side surface 43, also referred to as an end surface 43, of the nut as shown in FIG. 2 to form a sealing relationship in that region.

In an exemplary aspect, the connector-grasping portion 42 of the nut component 40 is an internally-projecting shoulder that engages a flange 25 on the connector post 23 (described below) in such a manner that the nut component (likewise, the seal assembly 90) can be freely rotated as it is held in place as part of the connector.

Figure 4:
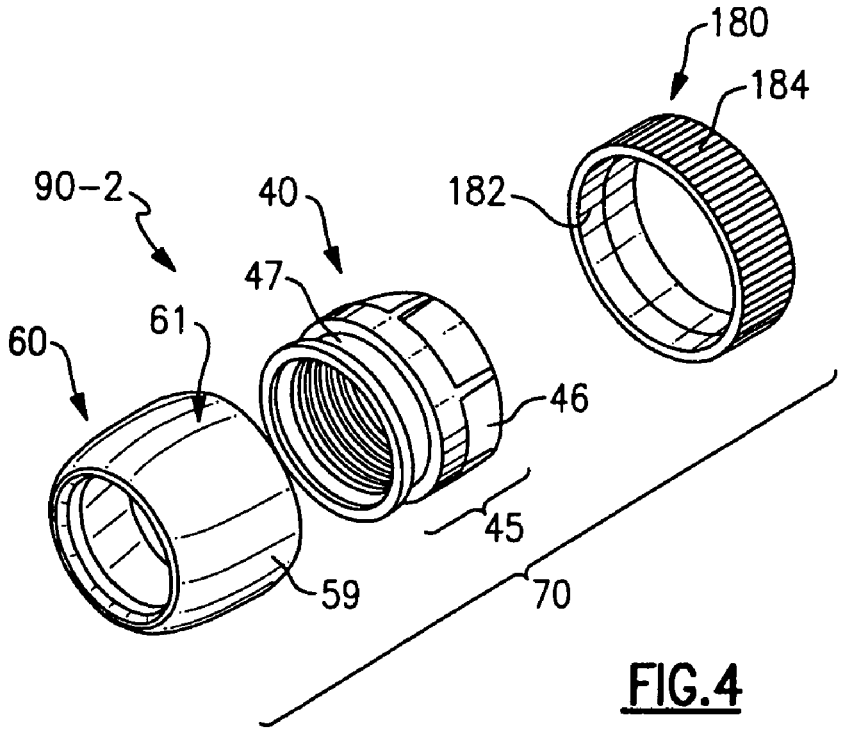
FIG. 4 is an exploded perspective view of a nut seal assembly according to another exemplary embodiment of the invention.

An additional exemplary aspect 90-2 of the seal assembly is illustrated in FIG. 4. The seal assembly of the invention may further include a seal ring 180 having an inner surface 182 and an outer surface 184. The inner surface has a diameter such that the seal ring is slid over the nut component and creates a press-fit against an exterior rear surface portion 61 of the seal that is radially adjacent the interior sealing surface 62 (See FIG. 2). This press fit over the posterior end 59 of the seal 60 enhances the sealing characteristics between the nut 40 and the interior 62 and posterior 64 sealing surfaces (See FIG. 2). In an exemplary aspect, the outer surface 184 of the seal ring 180 is knurled to facilitate hand-turning of the seal assembly. Flat portions 46 of the nut turning surface may remain exposed to additionally facilitate the use of a tool for turning the assembly.

Figure 5:
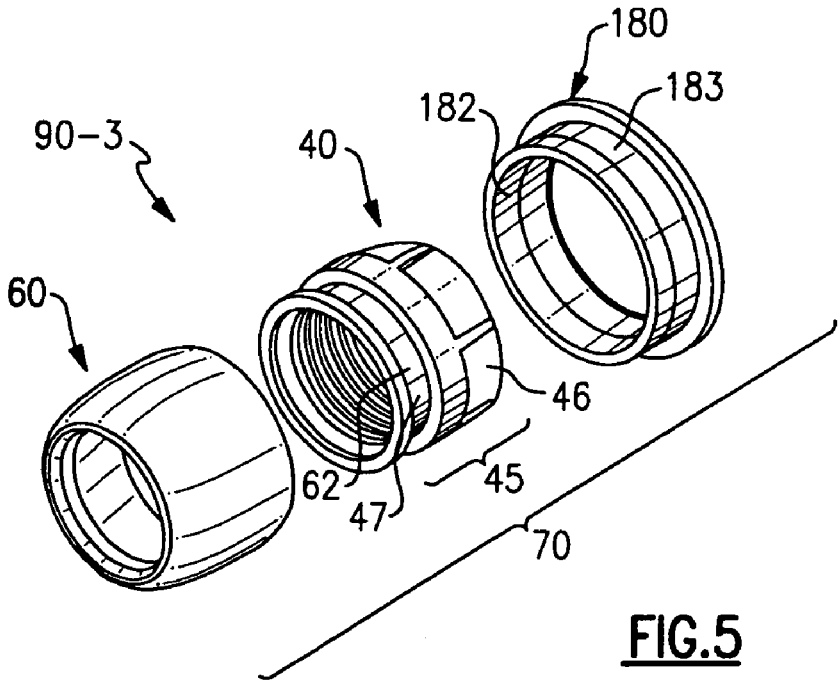
FIG. 5 is an exploded perspective view of a nut seal assembly according to another exemplary embodiment of the invention.

A further exemplary aspect 90-3 of the seal assembly is illustrated in FIG. 5. A seal ring 180' has a flange 183 extending outwardly from a posterior perimeter of the seal ring. As in the case of seal ring 180 described above, an internal surface 182 of seal ring 180' creates a press-fit against the exterior surface portion 61 of the seal that is radially adjacent the interior sealing surface 62. The flange 183 provides a surface that facilitates pushing the seal ring into its assembled position. As described above, flat portions 46 of the nut turning surface may remain exposed to additionally facilitate the use of a tool for turning the assembly.

Figure 6:
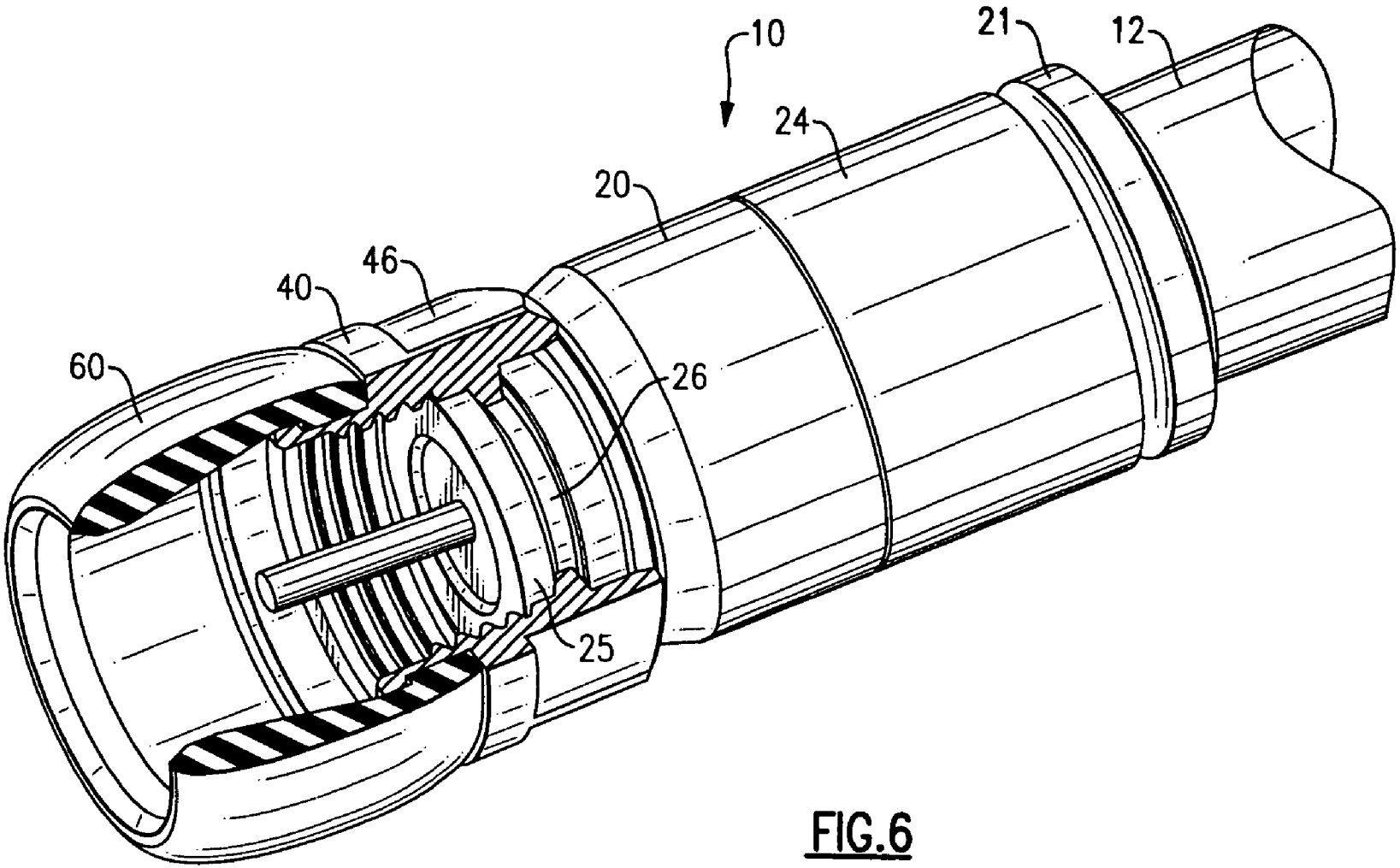
FIG. 6 is a partially sectioned perspective view of a coaxial cable connector in accordance with an exemplary embodiment the invention.
Figure 7:
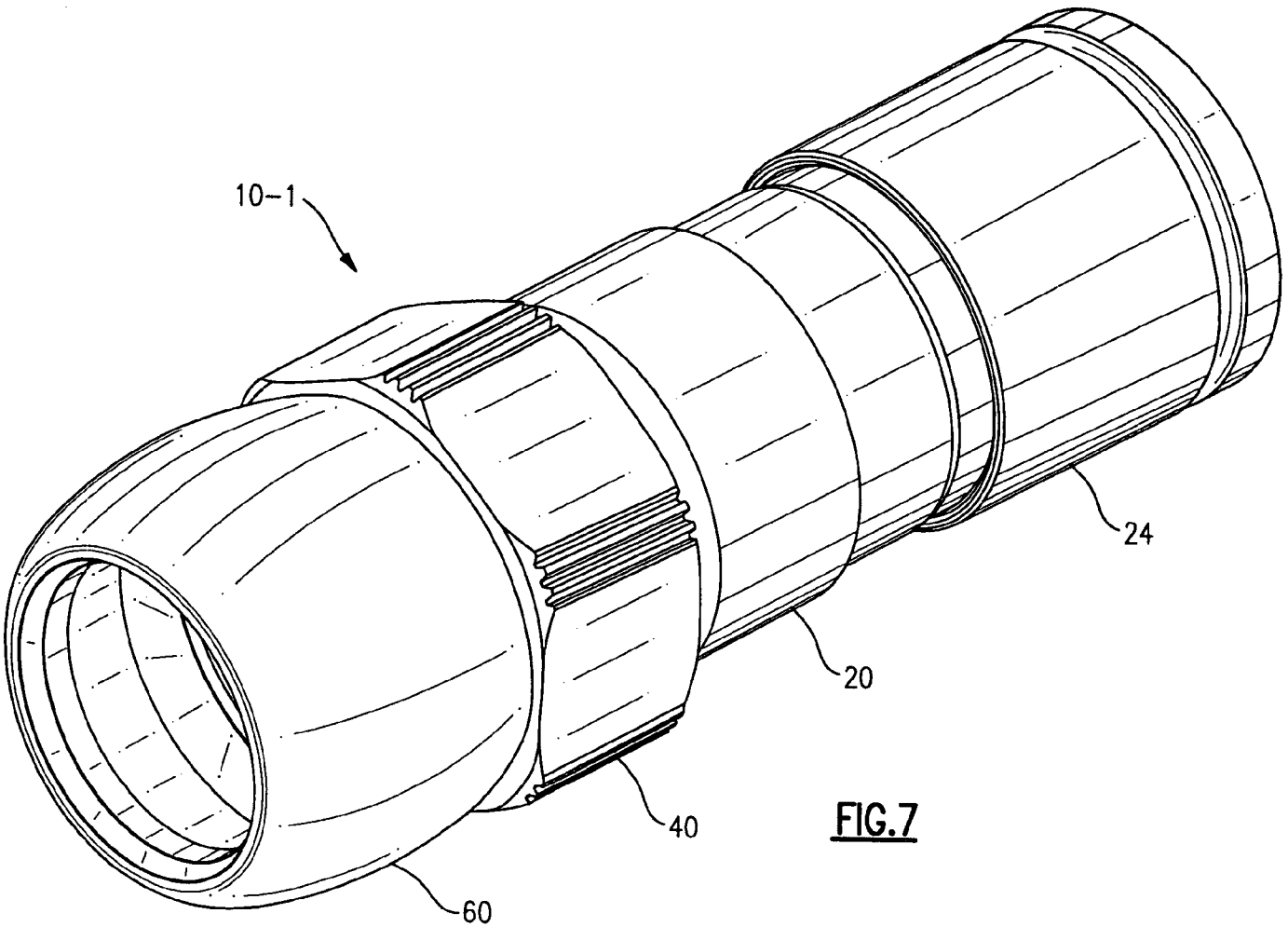
FIG. 7 is a perspective assembled view of the connector incorporating the nut seal assembly shown in FIG. 3.
Figure 8:
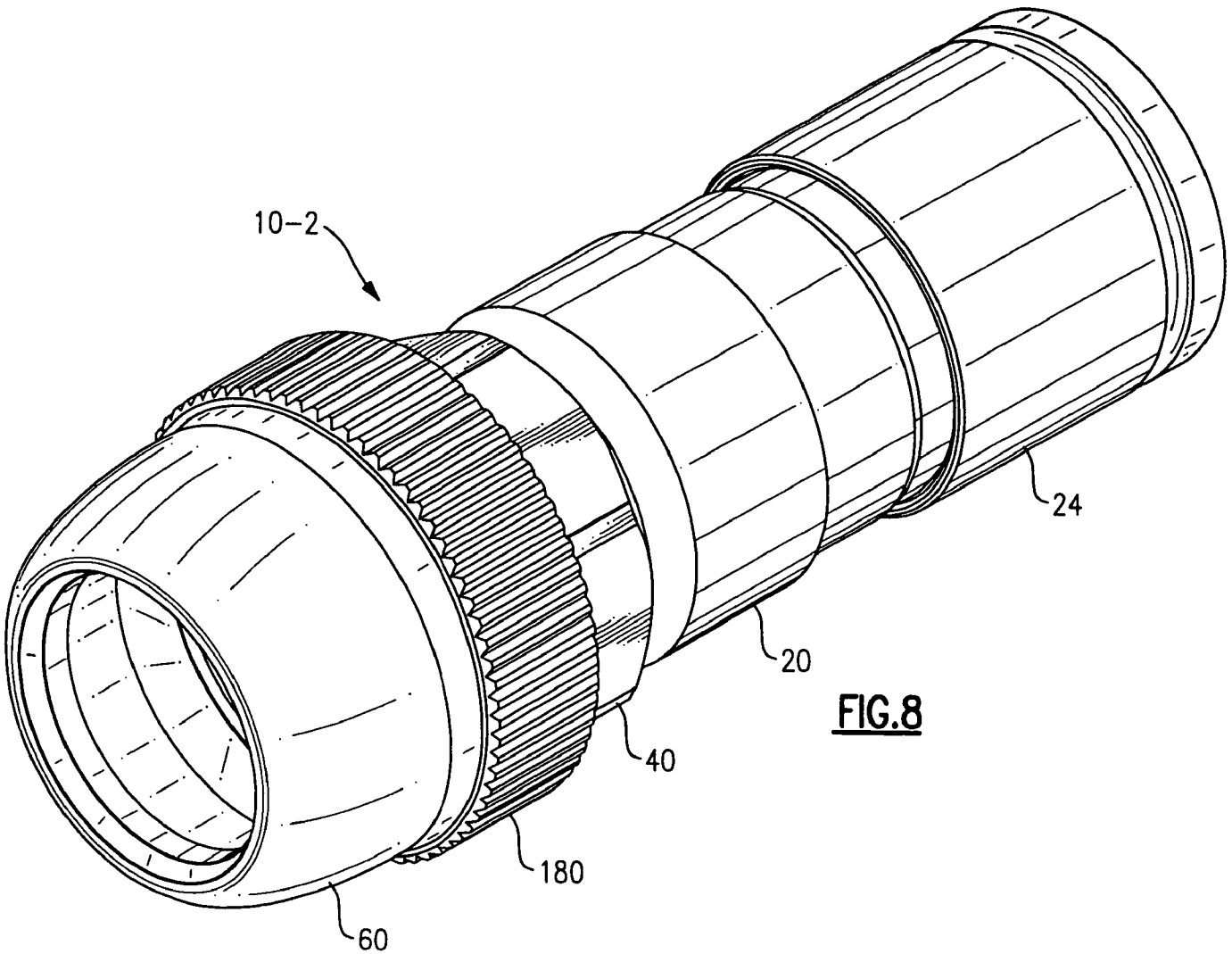
FIG. 8 is a perspective assembled view of the connector incorporating the nut seal assembly shown in FIG. 4.
Figure 9:
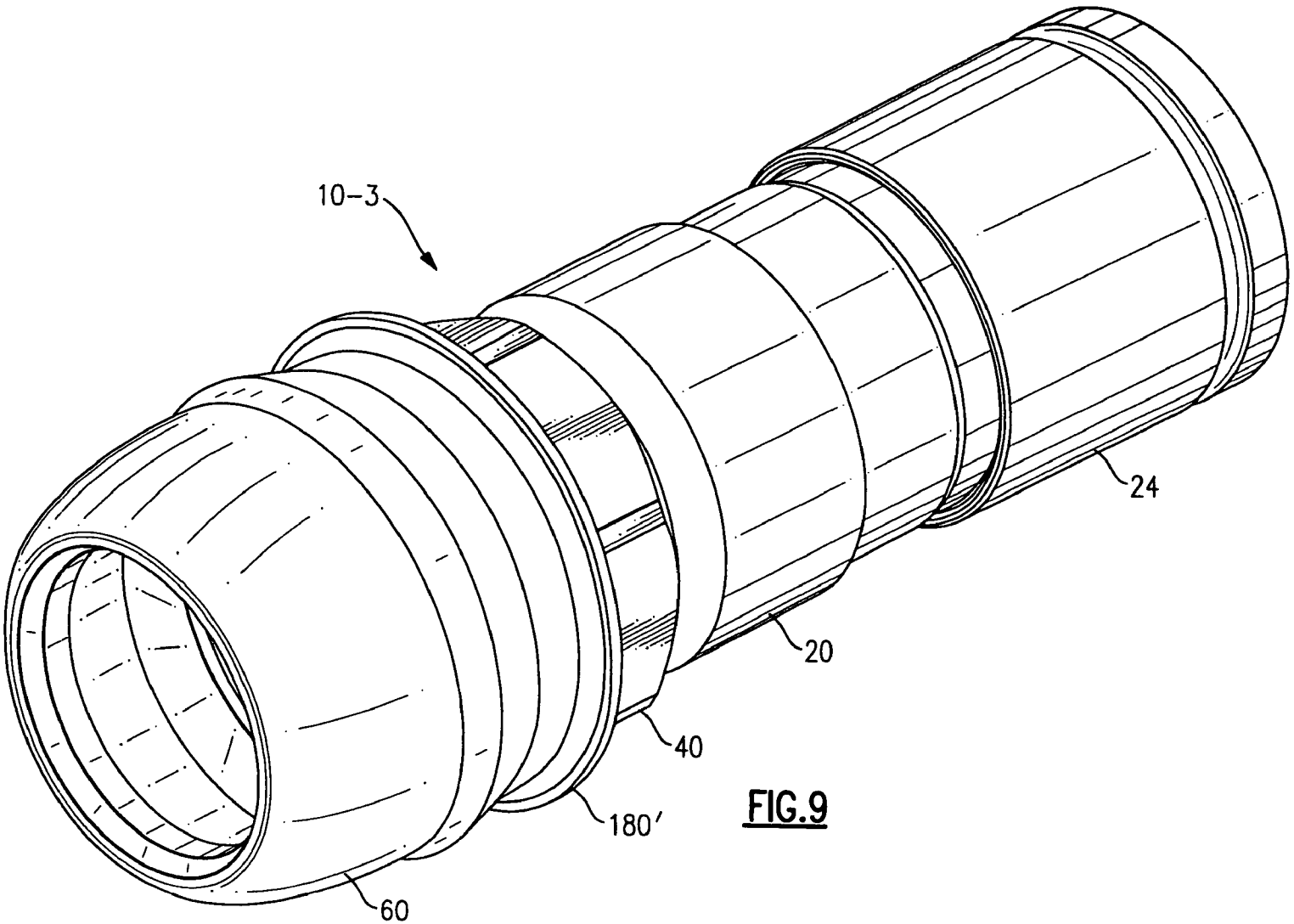
FIG. 9 is a perspective assembled view of the connector incorporating the nut seal assembly shown in FIG. 5.

Another embodiment of the invention is directed to a connector 10 as shown, for example, in FIGS. 3 and 6, for connecting a coaxial cable to a port 100, 110 and 120 as shown for illustration in FIGS. 10-12 respectively. The exemplary connector 10, illustrated in exploded view in FIG. 3, includes a tubular connector body 20 having first and second ends 21 and 22, respectively. The connector body 20 accepts and retains a coaxial cable 12 as shown in FIG. 6, by any one of many methods well known in the art. Well known means for attaching a connector body to the cable include hexagonal, circular or conical crimping and the radial compression of components caused by the axial or threaded rotational movement of tapered or stepped sleeves or rings. The exemplary connector 10 includes a connector post 23 (See FIG. 3) that functions, as is well known in the art, to electrically engage the outer conductor of the coaxial cable. Furthermore, the post 23 has a flange 25, which upon assembly with the connector body 20 provides a slot 26 (See FIG. 6) between the flange and the second end 22 of the body 20. Connector 10 further includes a nut component such as nut component 40 described above. The connector grasping shoulder 42 of the nut component 40 shown in FIG. 2 engages the slot 26, allowing the nut component to be an integral, rotatable part of the connector upon assembly. In the exemplary connector 10, a compression ring 24 slides over the connector body 20 to secure the integrity of the connector assembly. As described previously, seal 60 and nut component 40 form integral seal assembly 90 (See FIG. 2), which are part of connector 10. A cut-away view of exemplary connector 10 is shown in FIG. 6 and, as assembled, as connector 10-1 in FIG. 7. Alternative exemplary connectors 10-2, 10-3, incorporating respective seal assemblies 90-2, 90-3 (See FIGS. 4-5 respectively), are illustrated in FIGS. 8 and 9, respectively.

Figure 10A:
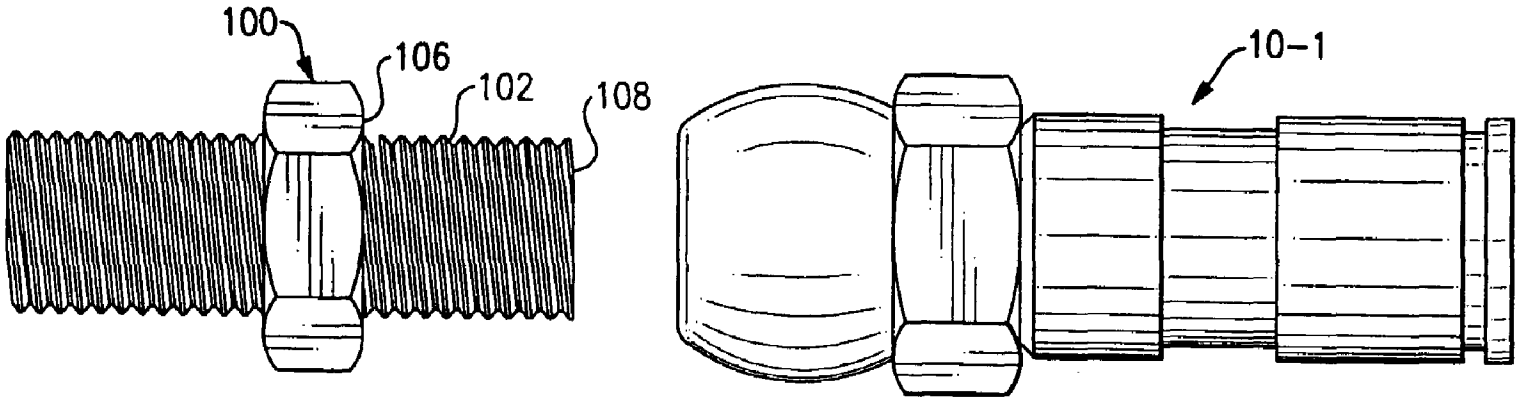
FIG. 10A is a plan view of an exemplary connector prior to engagement with an illustrative externally threaded port.

Exemplary illustrations of the intended use and configurations of connector 10 are shown in FIGS. 10-12. Referring to FIG. 10A, connector 10-1 is positioned in axial alignment with a "short" externally threaded port 100. Short port 100 has a length of external threads 102 extending from a terminal end 108 to an enlarged shoulder 106. The length of the external threads 102 is shorter than the length, L, of seal 60 (i.e., seal 60 in uncompressed state).

Figure 10B:
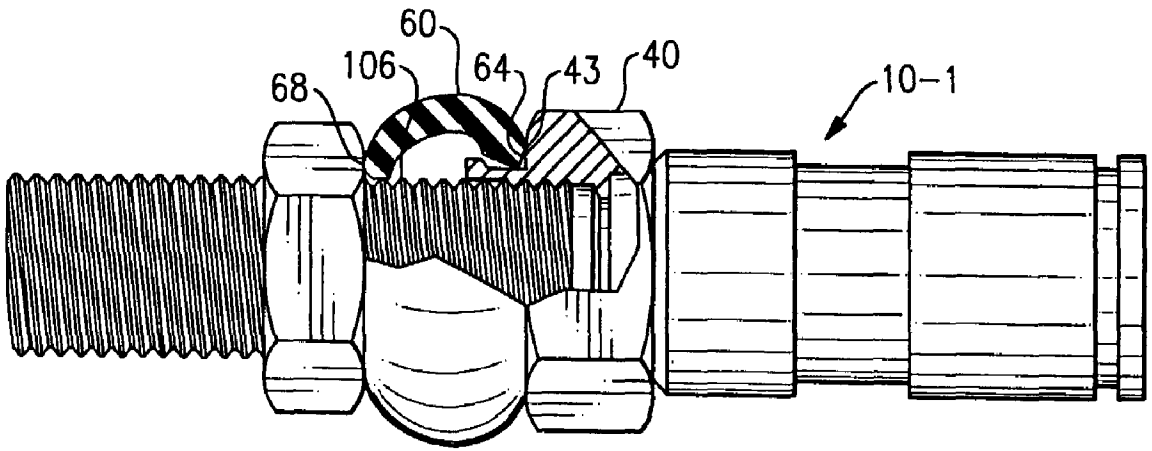
FIG. 10B is a partially sectioned plan view of the exemplary connector in FIG. 10A upon complete engagement with the illustrative externally threaded port.

Referring to FIG. 10B, connector 10-1 and short port 100 are shown "connected". Seal 60 is axially compressed between nut 40 and enlarged shoulder 106 of port 100. Posterior sealing surface 64 is axially compressed against side surface 43 of nut 40 and the end face 68*a* (See FIG. 2) of forward sealing surface 68 is axially compressed against enlarged shoulder 106 thus preventing ingress of environmental elements between nut 40 and enlarged shoulder 106 of the port 100.

Figure 11A:
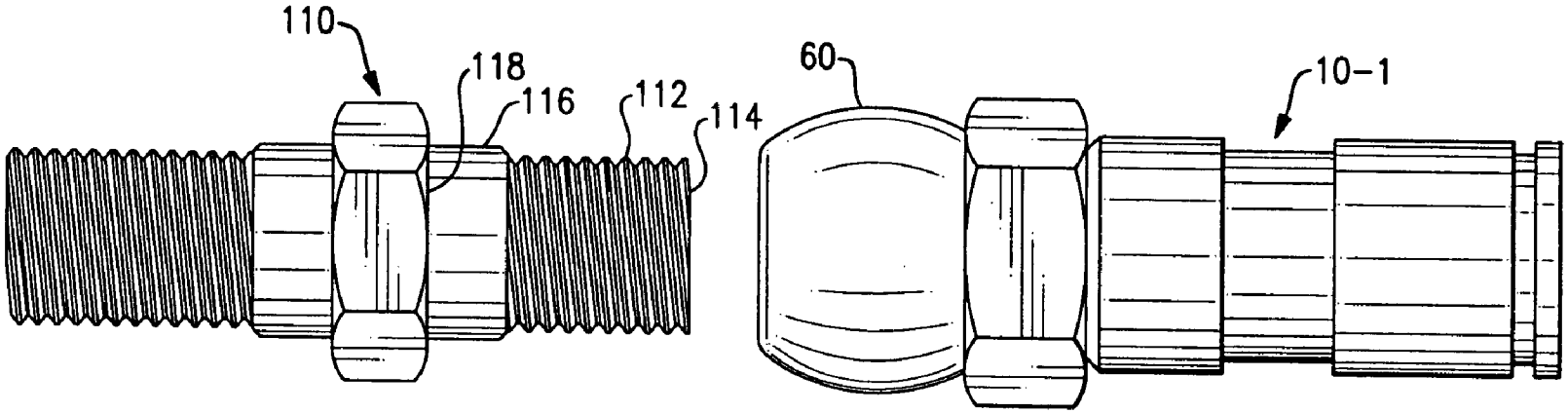
FIG. 11A is a plan view of an exemplary connector prior to engagement with a different illustrative externally threaded port.
Figure 11B:
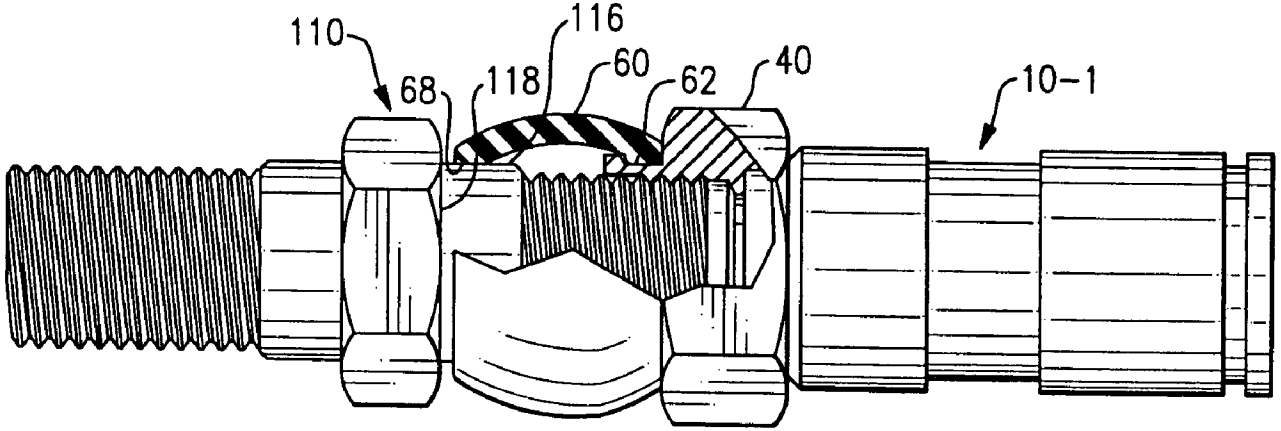
FIG. 11B is a partially sectioned plan view of the exemplary connector in FIG. 11A upon complete engagement with the illustrative externally threaded port.

Referring to FIG. 11A, connector 10-1 is positioned in axial alignment with a "long" externally threaded port 110. Long port 110 is characterized by having a length of external threads 112 extending from a terminal end 114 of port 110 to an unthreaded diameter 116 that is approximately equal to the major diameter of external threads 112. Unthreaded portion 116 then extends from external threads 112 to an enlarged shoulder 118. The length of external threads 112 in addition to unthreaded portion 116 is longer than the length that seal 60 extends outward from side surface 43 when seal 60 is in an uncompressed state.

Connector 10-1 and long port 110 are shown connected in FIG. 11B. Seal 60 is not axially compressed between nut 40 and enlarged shoulder 118. Rather, internal sealing surface 62 is radially compressed against the seal grasping surface 47 of nut 40 and the interior portion (annular facets) 68*b* and 68*c* (See FIGS. 1B) of forward sealing surface 68 are radially compressed against unthreaded portion 116, preventing the ingress of environmental elements between nut 40 and unthreaded portion 116 of port 110. The radial compression of both internal sealing surface 62 against seal grasping surface 47 of nut 40 and forward sealing surface 68 against unthreaded portion 116 is created by an interference fit between the sealing surfaces and their respective mating surfaces.

Figure 12A:
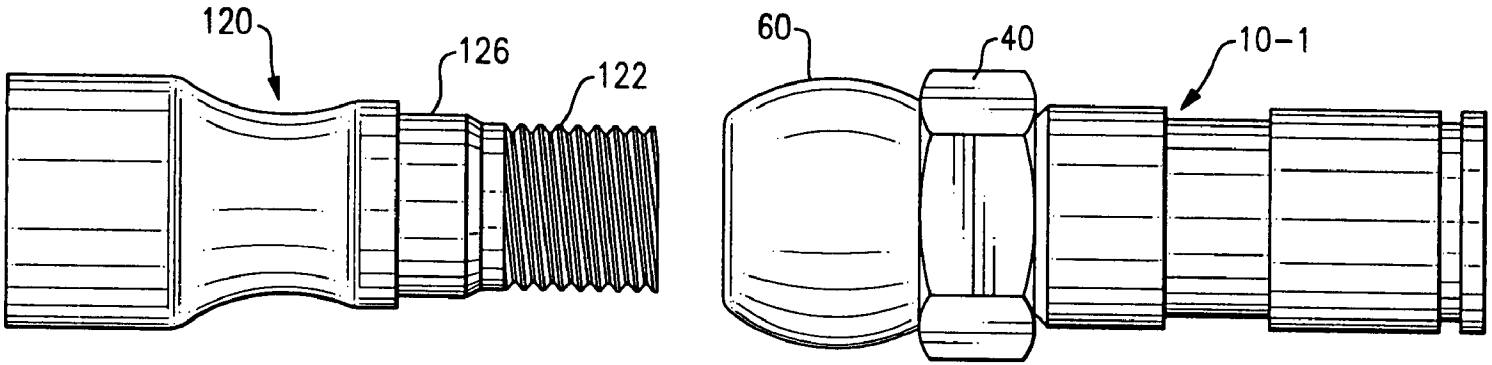
FIG. 12A is a plan view of an exemplary connector prior to engagement with a different illustrative externally threaded port.

FIG. 12A shows connector 10-1 positioned in axial alignment with an alternate externally threaded port 120. The portions 126, 122 of alternate port 120 are similar to those of long port 110 (FIG. 11), however, the diameter of the unthreaded portion 126 is larger than the major diameter of the external threads 122.

Figure 12B:
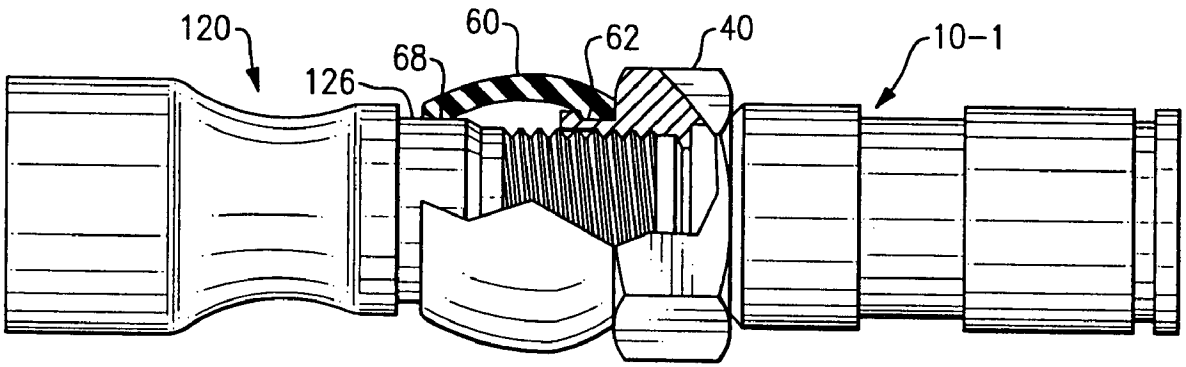
FIG. 12B is a partially sectioned plan view of the exemplary connector in FIG. 12A upon complete engagement with the illustrative externally threaded port.

As shown in FIG. 12B, connector 10-1 is connected to alternate port 120. Internal sealing surface 62 is radially compressed against seal grasping surface 47 (See FIG. 5) of nut 40 and forward sealing surface 68 is radially compressed against unthreaded portion 126, preventing the ingress of environmental elements between nut 40 and unthreaded portion 126. The radial compression of both the internal sealing surface 62 against seal grasping surface 47 of nut 40 and forward sealing surface 68 against unthreaded portion 126 is created by an interference fit between the sealing surfaces and their respective mating surfaces.

Figure 13:
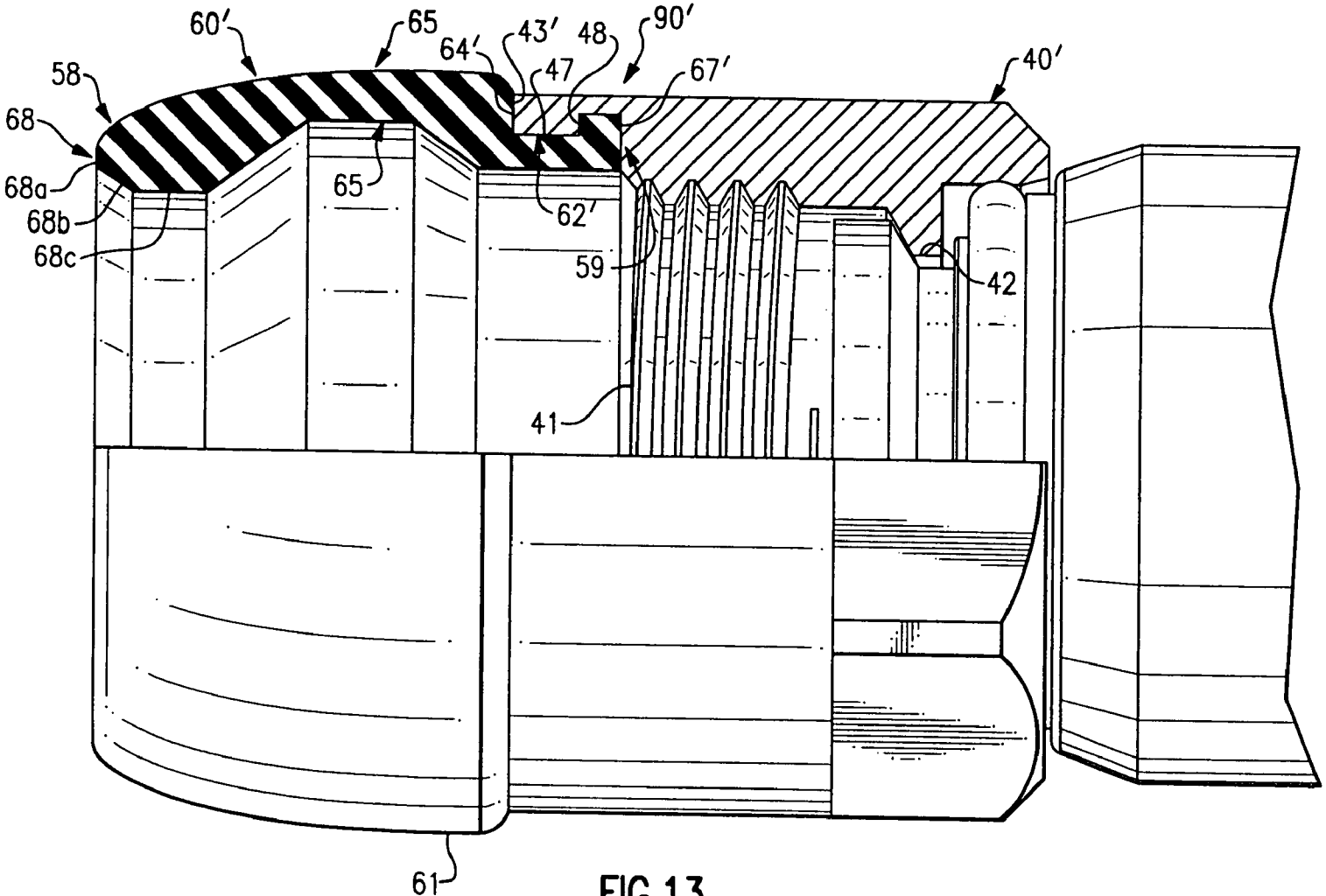
FIG. 13 is a partial cross sectional view of a modified embodiment of a seal assembly portion of the invention.
Figure 14:
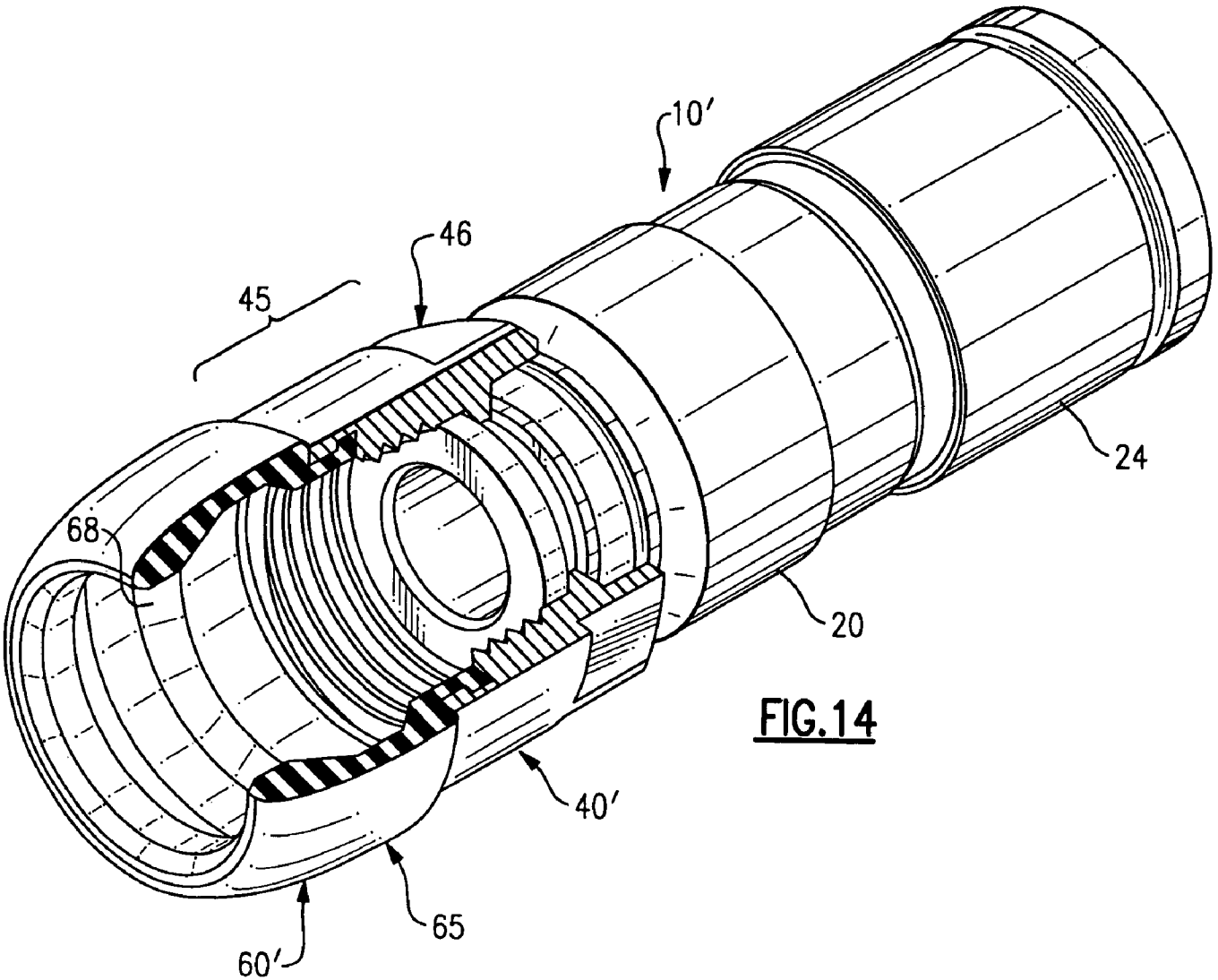
FIG. 14 is a partially sectioned perspective view of a modified alternative embodiment of a seal assembly portion of the invention.

A modified embodiment of the seal assembly 90' is illustrated in FIGS. 13 and 14. The materials function and operation of the modified embodiment of the seal assembly is substantially similar to the exemplary embodiment described above with the exception that the posterior portion of the seal 60' attaches to the interior surface rather than the exterior surface of the nut component 40'. The modified embodiment of the seal also has a generally tubular body that is elastically deformable by nature of its material characteristics and design. The tubular body of seal 60' has an anterior end 58 and a posterior end 59, the anterior end being a free end for ultimate engagement with a port, while the posterior end is for ultimate connection to the nut component 40' of the alternative seal assembly. The seal has a forward sealing surface 68 that may either have facets or a continuously curved surface, a rear sealing portion 61 including an exterior sealing surface 62' that integrally engages the nut component (described in greater detail below), and an intermediate section 65 intermediate the anterior end 58 and the posterior end 59 of the tubular body. The sealing surface 62' is an annular surface on the exterior of the tubular body. The seal 60' may also have a ridge 67' at the posterior end 59 which together with the nut grasping surface 62' locks in an interference fit with a corresponding shoulder 48 on the nut component 40', as illustrated. In its intended use, compressive axial force may be applied against one or both ends of the seal depending upon the length of the port intended to be sealed. The force will act to axially compress the seal whereupon it will expand radially in the vicinity of the intermediate section 65.

The nut component 40' of the modified seal assembly 90' (See FIG. 13) and connector 10' (See FIG. 14), illustrated by example in FIGS. 13 and 14, has an interior surface, at least a portion 41 of which is threaded, a connector-grasping portion 42, and an interior surface including a seal-grasping surface portion 47. In an aspect, the seal-grasping surface 47 can be a flat, smooth surface or a flat, roughened surface suitable to frictionally and/or adhesively engage the interior sealing surface 62' of the seal 60'. In an aspect, the seal-grasping surface 47 contains a shoulder 48 that is suitably sized and shaped to engage the ridge 67 of the posterior end 59 of the seal 60' sealing surface groove 62' in a locking-type interference fit as illustrated in FIGS. 13 and 14.

The modified nut component 40' further includes nut-turning surface portions 46 on surface 45. Upon engagement of the seal with the nut component, a sealing surface 64' of the seal abuts a end surface 43' of the nut as shown in FIGS. 13 and 14 to form a sealing relationship in that region. This modified embodiment of the seal assembly may be substituted for the preferred seal assembly of FIGS. 4 through 9 in the exemplary embodiments incorporating connectors and seal rings as described above.

Figure 15:
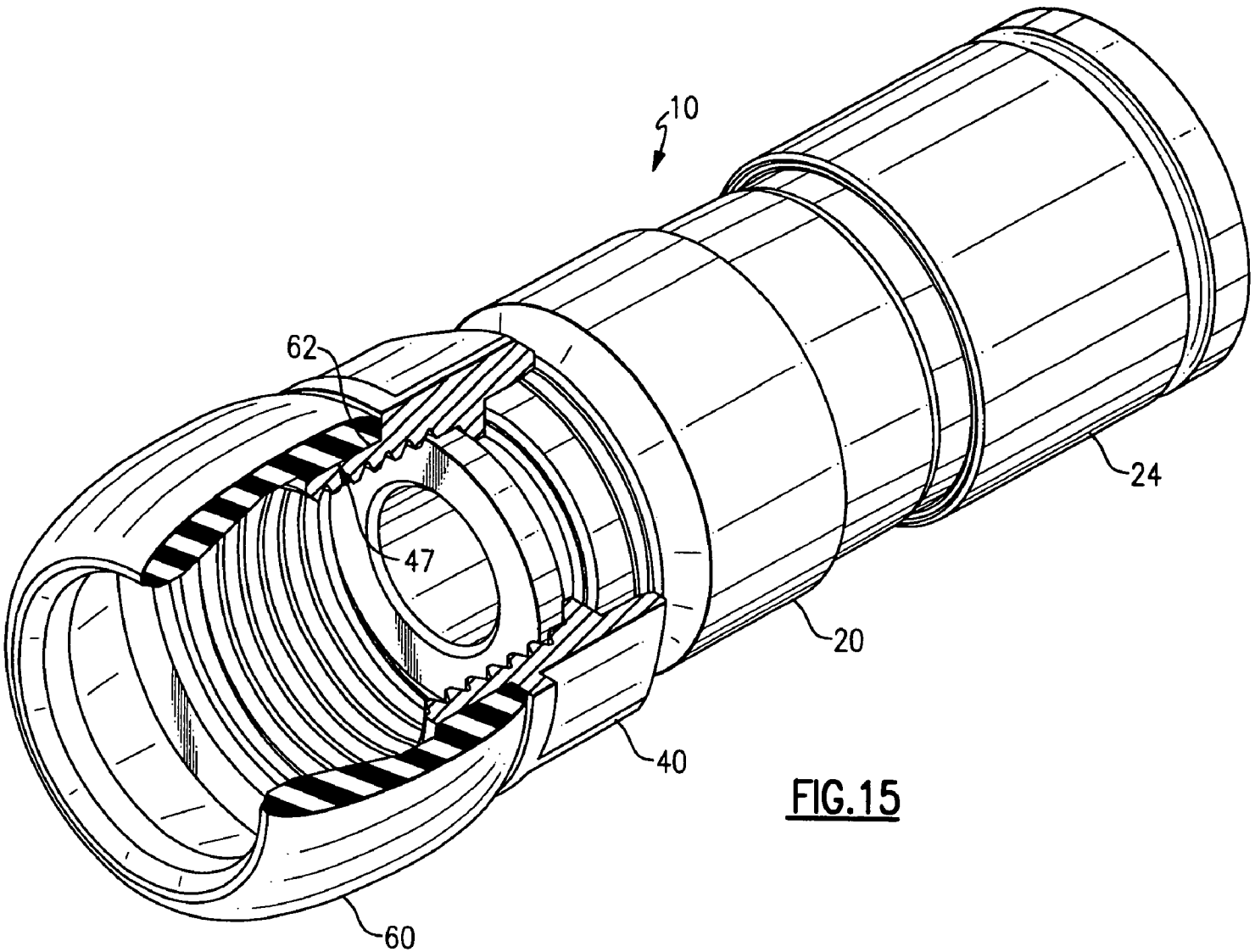
FIG. 15 is a partially sectioned perspective view of a second modified embodiment of a seal assembly portion of the invention.
Figure 16:
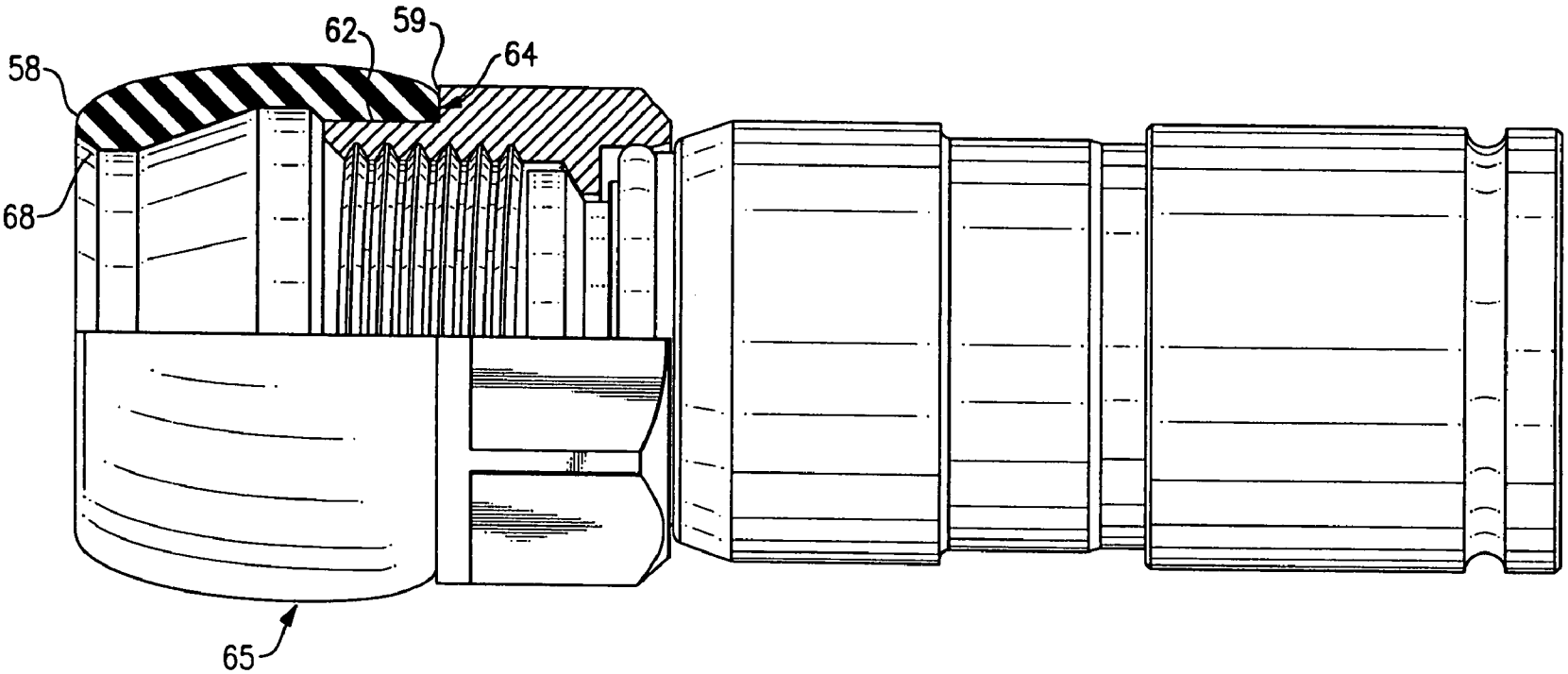
FIG. 16 is a partial cross sectional view of a second modified embodiment of a seal assembly portion of the invention.

A second modified embodiment of the seal assembly is illustrated in FIGS. 15 and 16. The seal-grasping surface 47 similarly can be a flat, smooth surface or a flat, roughened surface suitable to frictionally and/or adhesively engage the interior sealing surface of the seal 60. In this modified embodiment, however, the forward ridge that formed the interlocking interference fit between corresponding shoulders 48 and 67 (See FIG. 13) of the nut and the seal, respectively, have been eliminated. Rather, the nut seal is retained on the seal grasping surface due to either the compressive force of the elastomer material of the seal member on the seal grasping surface 47 or the frictional forces between these surfaces, alone or in conjunction with an adhesive bond between the seal grasping surface 47 of the nut 40 and the nut grasping surface 62 of the seal 60. In all other aspects, this second modified embodiment of the nut seal assembly and connectors incorporating the same operate in the same manner as exemplary embodiment of the assembly discussed above and depicted in FIGS. 1 through 12.

Figure 17:
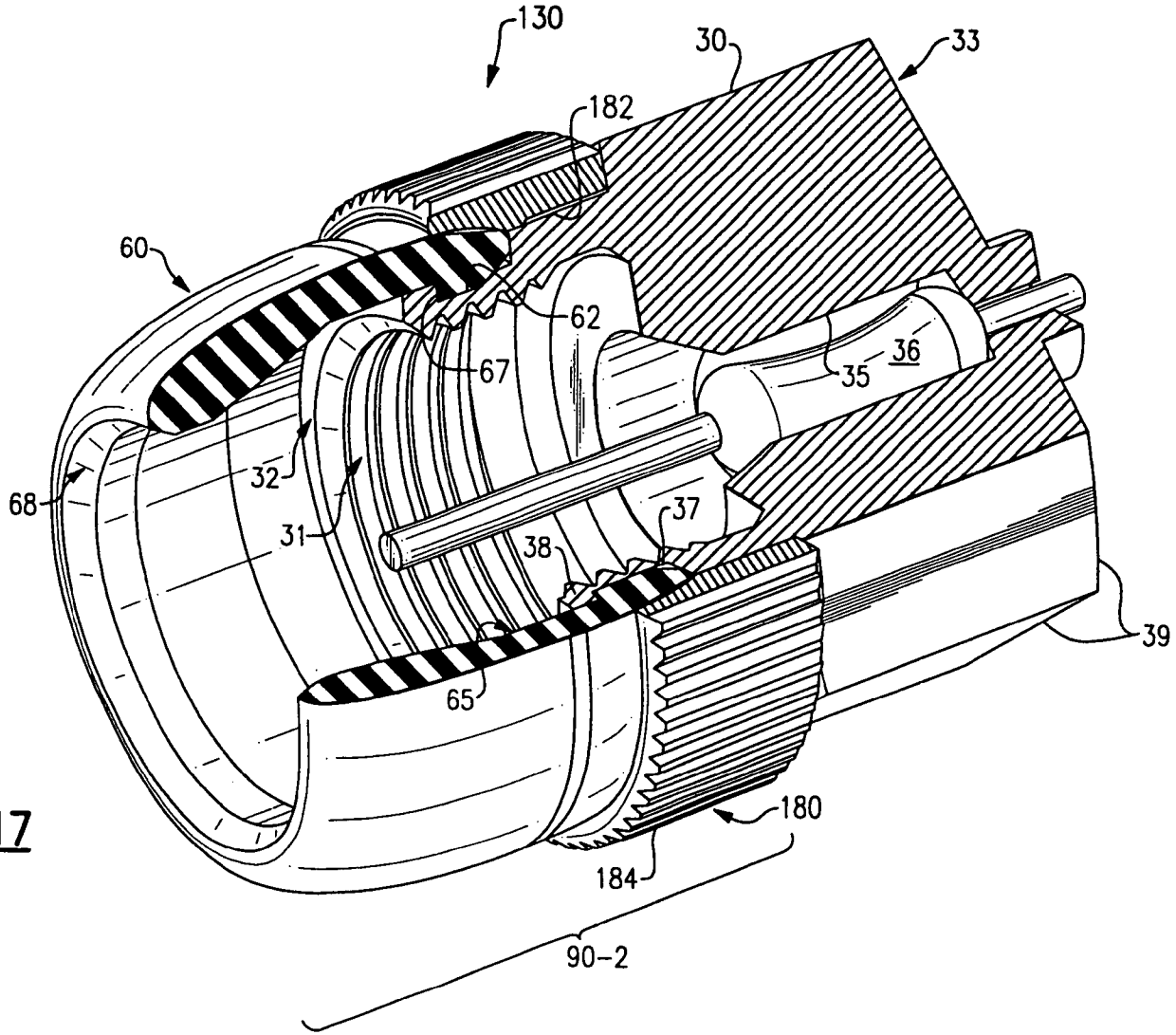
FIG. 17 is a partially cross sectioned perspective view of a termination device incorporating the nut seal assembly of the present invention.

A modified embodiment of the invention incorporated in a termination device or terminator is depicted in FIG. 17. The terminator 130 includes a housing 30 having a first end 32 and a second end 33, and a seal assembly 90-2. The first end 32 of the housing includes a bore defining an inner surface. A portion of the inner surface has interior threads 31 for engaging the threads of an unused cable port. The inner surface may also include a resistor chamber 35 for holding a resistor 36. The resistor matches the impedance of a coaxial cable to maintain the integrity of the signal carried to subscribers. The second end 33 of the housing may have an external surface including two or more flats 39, also referred to as flat surfaces, for the engagement of a tool such as a wrench. The external surface may be hexagonal in shape.

The first end of the housing also an exterior surface including a seal-grasping surface portion 37. In an aspect, the seal-grasping surface 37 can be a flat, smooth surface or a flat, roughened surface suitable to frictionally and/or adhesively engage the interior sealing surface 62 of the seal 60. In an exemplary aspect, the seal-grasping surface 37 may also contain a ridge 38 that together with the seal grasping surface forms a groove or shoulder that is suitably sized and shaped to correspondingly engage the internal shoulder 67 of the seal adjacent the interior sealing surface 62 in a locking-type interference fit between the terminator housing 30 and the seal 60 as illustrated in FIG. 17.

In all aspects, the seal 60 is substantially as the exemplary seal described above and as illustrated in FIGS. 1A, 1B, 1C, and FIG. 2. The seal 60 has a generally tubular body that is elastically deformable by nature of its material characteristics and design. The seal has a forward sealing surface 68, a rear sealing portion 61 including an interior sealing surface 62 that integrally engages either the cylindrical outer surface of the housing 37 or the ridge 38, and an intermediate section 65 intermediate the anterior end 58 and the posterior end 59 of the tubular body.

The seal assembly of the invention incorporated in a termination device may further include a seal ring 180 having an inner surface 182 and an outer surface 184. In all aspects, the seal ring 180 is as described above and as illustrated in FIG. 4. The seal ring inner surface has a diameter such that the seal ring is slid over the terminator housing 30 and creates a press-fit against an exterior rear surface portion 61 of the seal that is radially adjacent the interior sealing surface 62. This press fit over the posterior end 59 of the seal 60 enhances the sealing characteristics between the housing 30 and the interior 62 and posterior 64 sealing surfaces. In an exemplary aspect, the outer surface 184 of the seal ring 180 is knurled to facilitate hand-turning of the seal assembly. In all other aspects, this embodiment of the seal assembly incorporated on the terminator operates in the same manner as exemplary embodiment of the assembly discussed above and depicted in FIGS. 1 through 12.

Figure 18:
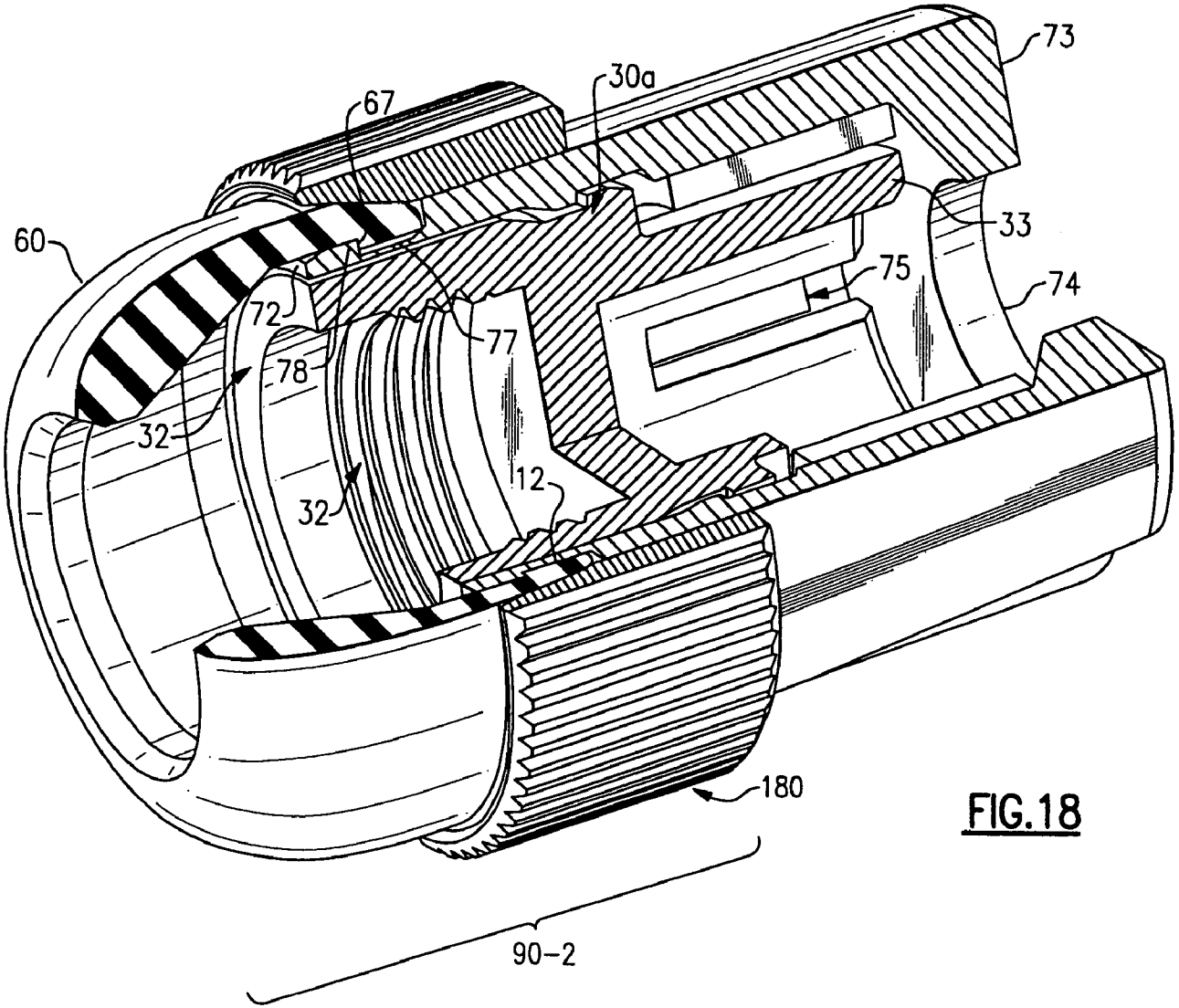
FIG. 18 is a partially cross sectioned perspective view of a tamper-resistant termination device incorporating the nut seal assembly of the present invention.

A further modified embodiment of the invention incorporated in a tamper-resistant termination device is depicted in FIG. 18. The terminator 130*a* includes a generally cylindrical housing 30*a* having a first end 32 and a second end 33, an outer shell 70 (See FIG. 5) with a first end 72 and a second end 73, and a seal assembly 90-2. The first end 32 of the housing includes a bore defining an inner surface. A portion of the inner surface has interior threads 31 for engaging the threads of an unused cable port. The outer shell 70 rotates independently of the housing 30 and has an opening 74 at the second end for the insertion of a specialized tool (not shown) for mating with a complementary structure 75 on the second end of the housing. Once the tool is properly engaged with the housing, rotation of the tool causes rotation of the housing 30 to selectively install or remove the housing from the threaded port. In all aspects, the seal 60 is substantially the exemplary seal described above and as illustrated in FIGS. 1A, 1B, 1C, and FIG. 2.

The first end 72 of the shell also an exterior surface including a seal-grasping, cylindrical surface portion 77. In an aspect, the seal-grasping surface 77 can be a flat, smooth surface or a flat, roughened surface suitable to frictionally and/or adhesively engage the interior sealing surface 62 of the seal 60. In an exemplary aspect, the seal-grasping surface 77 may also contain a ridge 78 that together with the seal grasping surface forms a groove or shoulder that is suitably sized and shaped to correspondingly engage the internal shoulder 67 of the seal adjacent the interior sealing surface 62 in a locking-type interference fit between the outer shell 70 and the seal 60 as illustrated in FIG. 18.

The seal assembly of the invention incorporated in the tamper resistant termination device may further include a seal ring 180 having an inner surface 182 and an outer surface 184. In all aspects, the seal ring 180 is as described above and as illustrated in FIG. 4. The seal ring inner surface has a diameter such that the seal ring is slid over the outer shell 70 and creates a press-fit against an exterior rear surface portion 61 of the seal that is radially adjacent the interior sealing surface 62. This press fit over the posterior end 59 of the seal 60 enhances the sealing characteristics between the outer shell 70 and the interior 62 and posterior 64 sealing surfaces. In all other aspects, this embodiment of the seal incorporated on the tamper-resistant terminator operates in the same manner as the exemplary embodiment of the seal discussed above and depicted in FIGS. 1 through 12.

Figure 19:
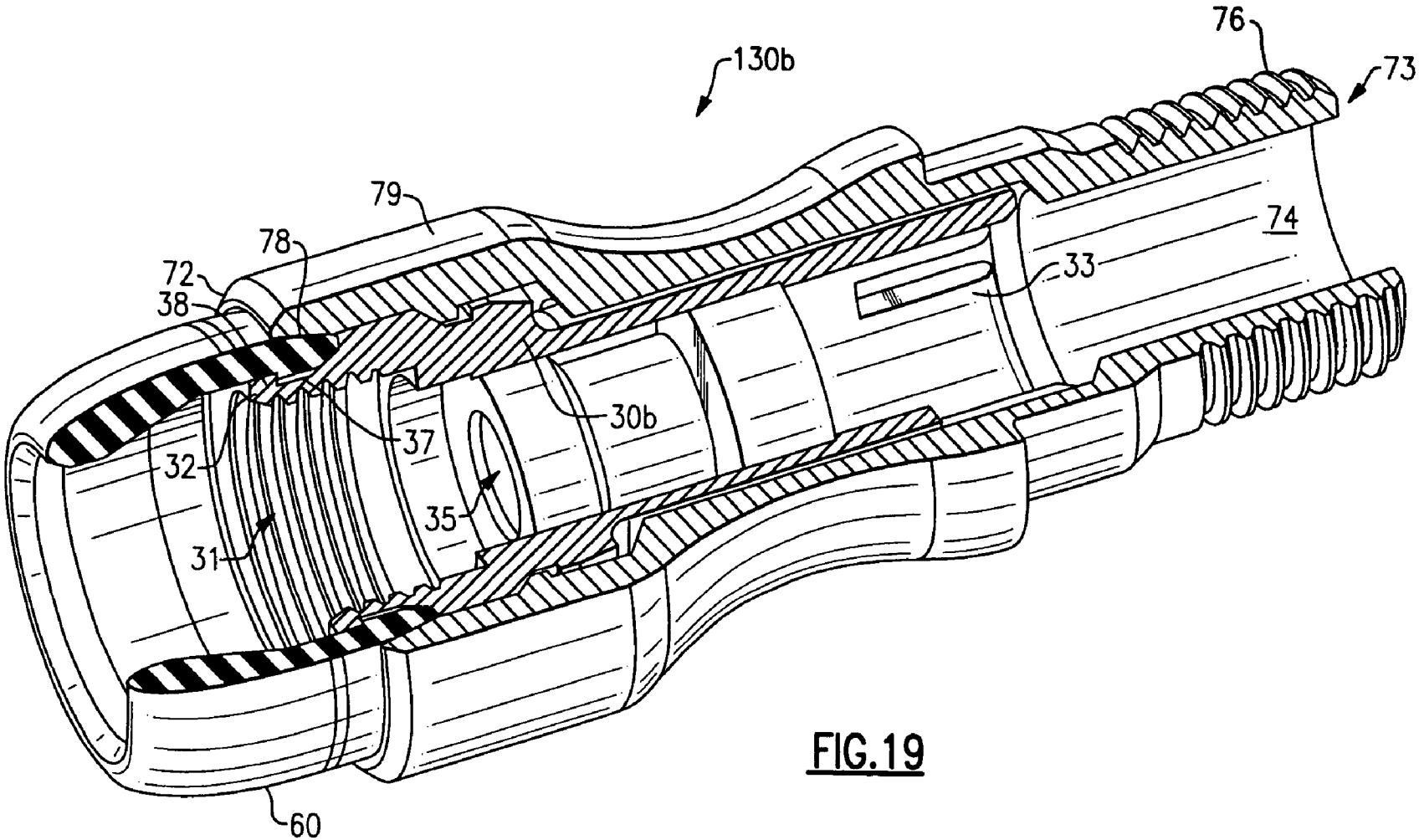
FIG. 19 is a partially cross-sectioned perspective view of a alternative embodiment of a tamper-resistant termination device incorporating the nut seal assembly of the present invention.

A still further modified embodiment of the invention incorporated in another tamper-resistant termination device is depicted in FIG. 19. The terminator 130*b* is in many features similar to the termination device 130*a* of FIG. 18. The second end 73 of the outer shell also includes external threads 76 for the mating of a coaxial cable connector (not shown). Such a termination device may be positioned between a previously used output port and the corresponding drop line when the service to that particular subscriber is suspended without requiring that the full wiring to that subscriber be removed. Service can be restored simply by removing the interposed termination device and reconnecting the cable to the port.

In lieu of the seal ring, the first end 72 of the outer shell 70 has an inner surface 78 and an outer surface 79. The inner surface 78 of the first end of the outer shell is 70 configured to be radially above the seal-grasping, cylindrical surface 37 of the terminator housing 30*b* and creates a press-fit against an exterior rear surface portion 61 of the seal that is radially adjacent the interior sealing surface 62. In other all aspects, this embodiment of the seal 60 incorporated on the tamper-resistant terminator 130*b* operates in the same manner as exemplary embodiment of the seal assembly discussed above and depicted in FIG. 18.

Figure 20:
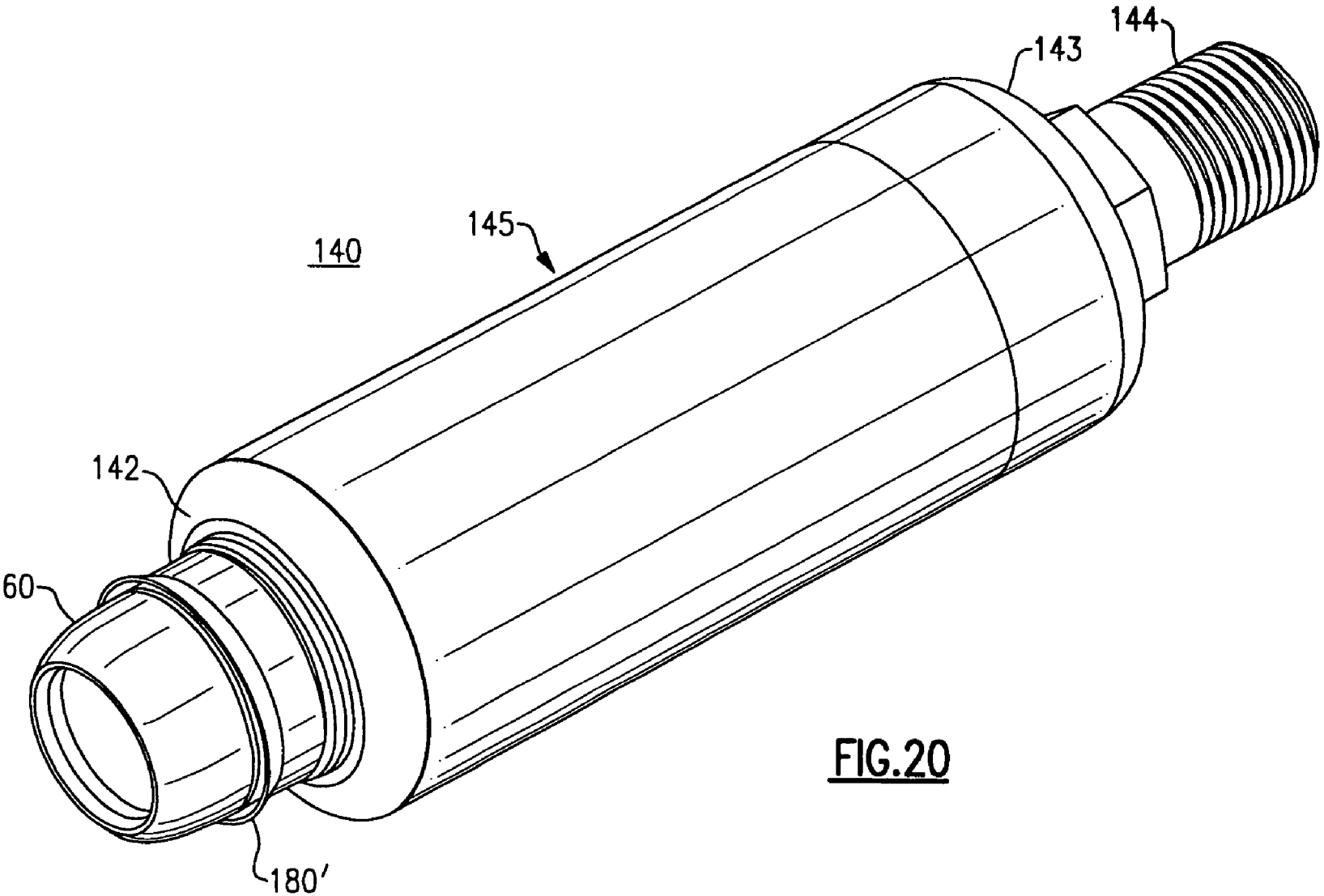
FIG. 20 is a perspective view of a first embodiment of a filter housing incorporating the nut seal assembly of the present invention.
Figure 21:
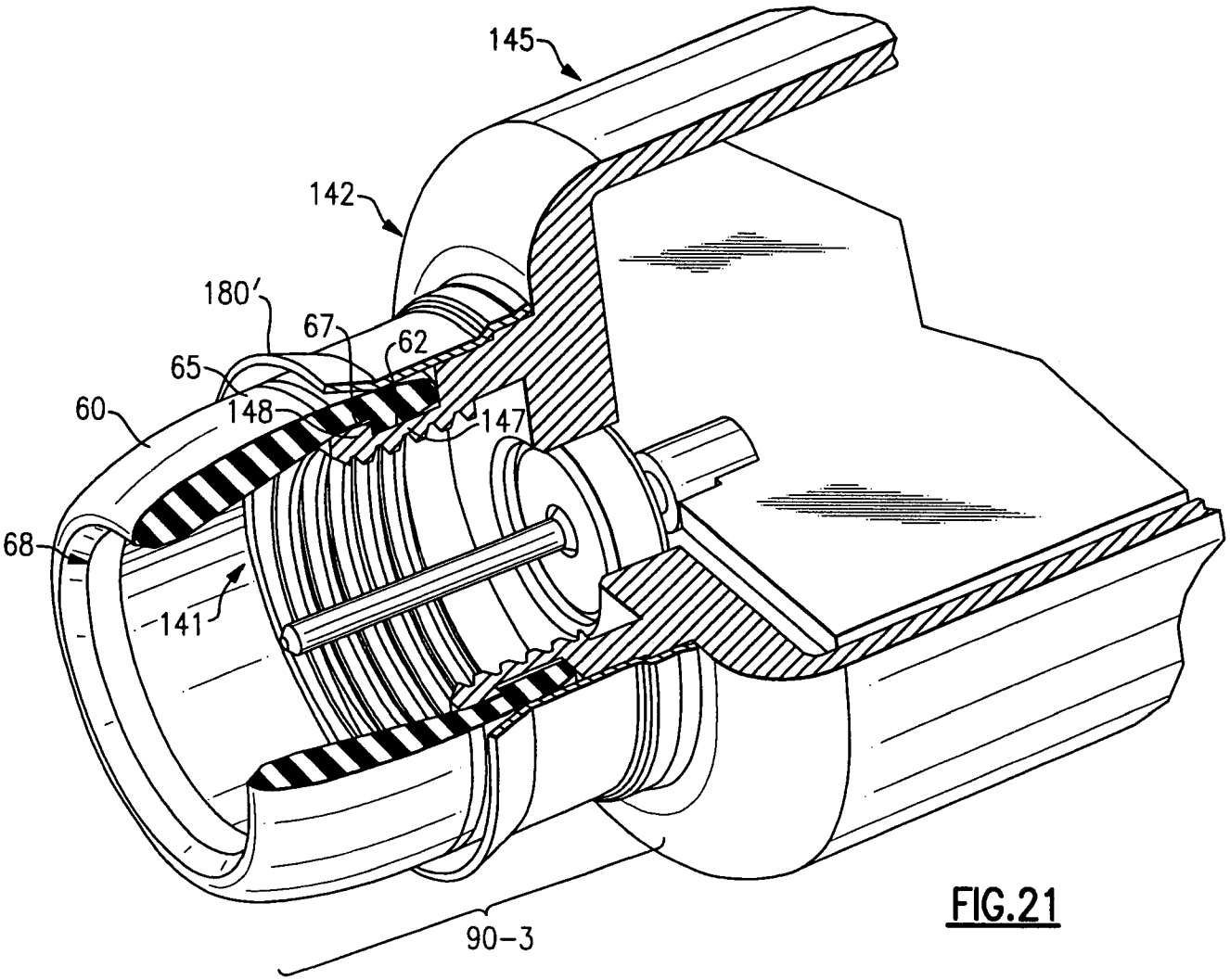
FIG. 21 is a partially cross-sectioned perspective view of the filter housing of FIG. 20.

A modified embodiment of the invention incorporated in a filter or trap 140 is depicted in FIGS. 20 and 21. The filter includes a generally cylindrical housing 145 having a first end 142 including an internally threaded connector 141 and a second end 143 including an externally threaded connector 14, and a seal assembly 90-3 surrounding the internally threaded connector 141 at the first end of the filter housing. The exterior surface of the internally threaded connector includes a seal-grasping surface portion 147. In an aspect, the seal-grasping surface 147 can be a flat, smooth surface or a flat, roughened surface suitable to frictionally and/or adhesively engage the interior sealing surface 62 of the seal 60. In an exemplary aspect, the seal-grasping surface 147 may also contain a ridge 148 that together with the seal grasping surface forms a groove or shoulder that is suitably sized and shaped to correspondingly engage the internal shoulder 67 of the seal adjacent the interior sealing surface 62 in a locking-type interference fit between the connector 141 and the seal 60 as illustrated in FIGS. 2, 17 and 18.

In all aspects, the seal 60 is substantially the exemplary seal described above and as illustrated in FIGS. 1A, 1B, 1C, and FIG. 2. The seal 60 has a generally tubular body that is elastically deformable by nature of its material characteristics and design. The seal has a forward sealing surface 68, a rear sealing portion 61 including an interior sealing surface 62 that integrally engages either the seal-grasping surface 147 of the connector 141 or the ridge 148, and an intermediate section 65 intermediate the anterior end 58 and the posterior end 59 (See FIG. 16) of the tubular body.

The seal assembly of the invention incorporated in a filter housing may further include a seal ring 180' having an inner surface 182 and an outer surface 184 (See FIG. 17). In all aspects, the seal ring 180' is as described above and as illustrated in FIG. 5. The seal ring inner surface has a diameter such that the seal ring 180' is slid over the internally threaded connector and creates a press-fit against an exterior rear surface portion 61 of the seal that is radially adjacent the interior sealing surface 62. This press fit over the posterior end 59 (See FIG. 16) of the seal 60 enhances the sealing characteristics between the connector 141 and the interior 62 and posterior 64 sealing surfaces. In an exemplary aspect, the outer surface 184 of the seal ring 180 may include a flange 183 (See FIG. 5) to facilitate pushing the seal ring into its assembled position and to facilitate hand-turning of the seal assembly. In all other aspects, this embodiment of the seal assembly incorporated on the filter operates in the same manner as exemplary embodiment of the assembly discussed above and depicted in FIGS. 5 and 9.

Figure 22:
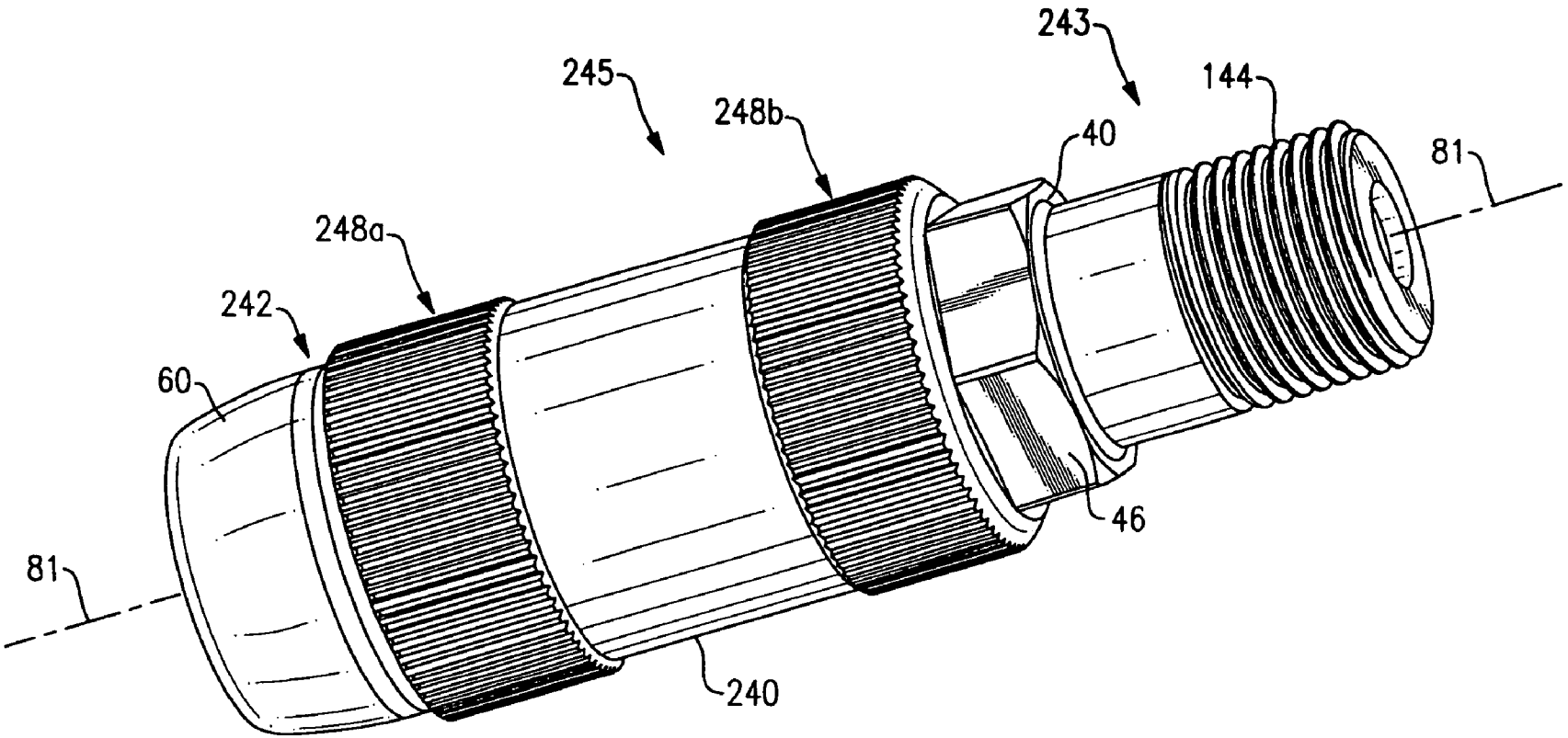
FIG. 22 is a perspective view of a second embodiment of a filter housing including at least one textured surface that is located adjacent to an outer sleeve.

FIG. 22 is a perspective view of a second embodiment of a filter housing including at least one textured surface that is located adjacent to an outer sleeve. As shown, the filter housing 245 is disposed around an axis of rotation 81 and incorporates the nut seal assembly including a seal 60 that was previously described (See FIGS. 4-5). Like shown in FIGS. 20-21, the filter housing 245 is of a generally cylindrical shape and has a first end 242 including an internally threaded connector (See FIG. 21) and a second end 243 including an externally threaded connector 144, like shown in FIG. 20. The outer sleeve 240 is typically constructed from a sheet of metal that is shaped to form a cylindrical outer surface of the filter housing 245.

Unlike that shown in FIGS. 20-21, the filter housing 245 includes at least one textured surface 248*a*, 248*b*. Each textured surface 248*a*, 248*b* is configured to enable a person, such as a CATV maintenance person, also referred to as an installer, to hand grip and rotate the filter housing 245 in either direction around its rotational axis 81.

In one intended use scenario, an installer, hand grips the filter housing 245 at points of physical contact located along at least one of the textured surfaces 248*a*, 248*b*. In another use scenario, the installer employs a tool, such as a wrench, to grip and to apply a rotational force to the flat portions 46 of the outer surface of the nut 40 in order to rotate the filter housing 245 in either direction around its rotational axis 81.

Each textured surface 248*a*, 248*b* is configured to enhance frictional contact between itself and the hand of the installer. As shown and by way of example, each textured surface includes a plurality of substantially parallel ridge lines. Each textured surface 248*a*, 248*b* is not limited to any one surface pattern and can include a mixed variety of raised and unraised surface shapes and topologies, including point shaped peaks and/or combinations of other shaped ridge patterns. In some embodiments, the textured surface 248*a*, 248*b* can include simple knurling and/or sticky and/or elastomeric grips.

In accordance with the invention, as a result of the inclusion of the textured surfaces 248*a*, 248*b* into the filter housing 245, the installer can hand grip and generate a sufficient rotational force upon the filter housing 245 in order to install or uninstall the filter housing 245 onto another mating connector, such as provided by a CATV distribution box port, for example. Optionally, the installer can apply a tool to the nut 40 to install or uninstall the filter housing 245 to another mating connector.

Figure 23:
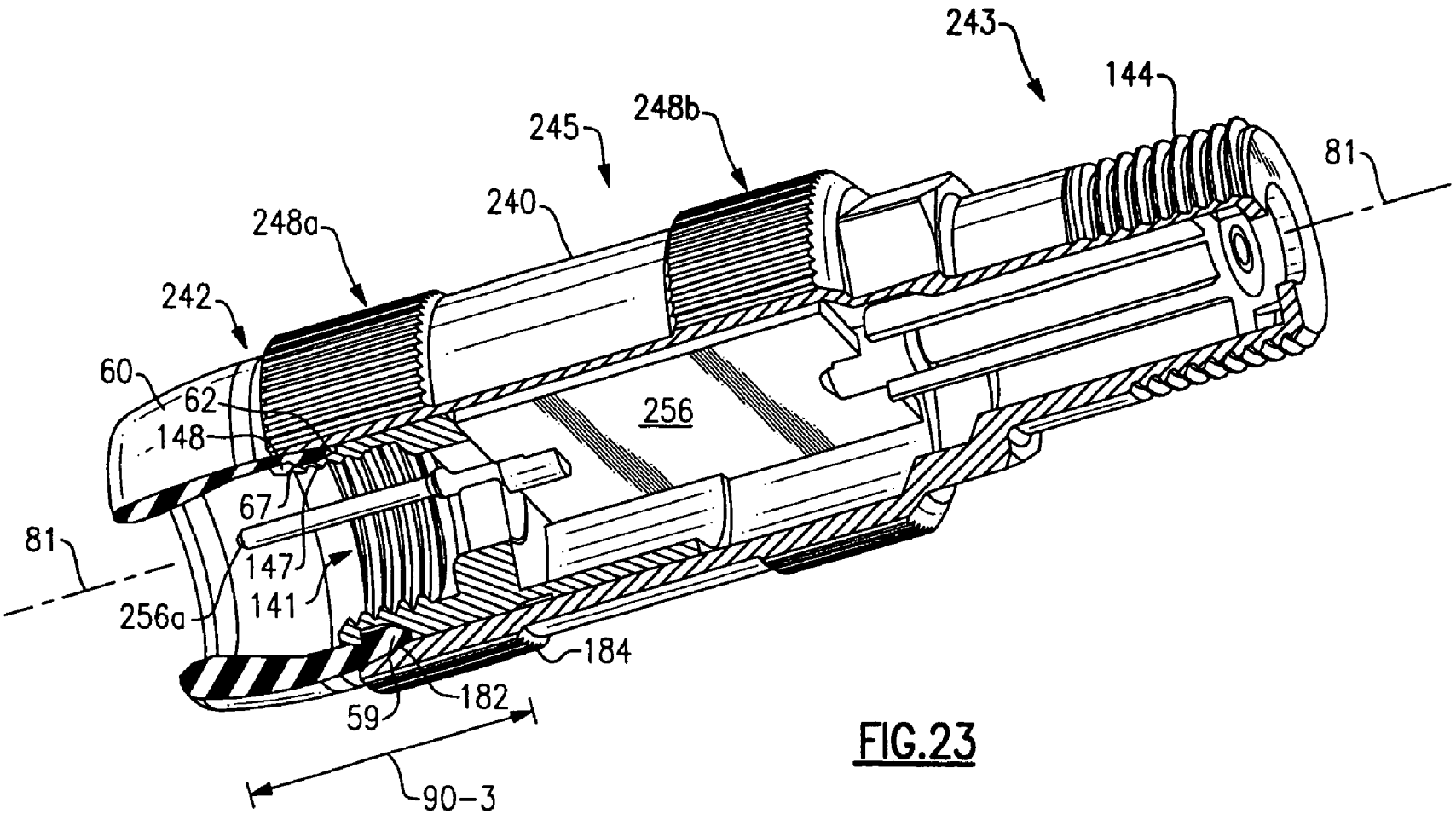
FIG. 23 is a partially cross-sectioned perspective view of the second embodiment of a filter housing of FIG. 22 including the textured surfaces and the outer sleeve.

FIG. 23 is a partially cross-sectioned perspective view of the second embodiment of a filter housing 245 of FIG. 22 including the textured surfaces 248*a*, 248*b* and the outer sleeve 240. Like shown in FIG. 21, a seal assembly 90-3 includes a seal 60, and surrounds the internally threaded connector 141 at the first end 242 of the filter housing 245. The seal 60 is substantially as previously described and as illustrated in FIGS. 1A, 1B, 1C, and FIG. 2, for example. The outer sleeve 240 is typically constructed from a sheet of metal that is shaped to form a cylindrical outer surface of the filter housing 245.

Like that shown in FIG. 21, the exterior surface of the internally threaded connector 141 includes a seal-grasping surface portion 147. In one embodiment, the seal-grasping surface 147 can be a flat, smooth surface or a flat, roughened surface suitable to frictionally and/or adhesively engage the interior sealing surface 62 of the seal 60. Optionally, the seal-grasping surface 147 may also contain a ridge 148 that together with the seal grasping surface 147 forms a groove or a shoulder 148 that is suitably sized and shaped to correspondingly engage an internal shoulder 67 of the seal 60 adjacent the interior sealing surface 62 in a locking-type interference fit between the connector 141 and the seal 60 as also illustrated in FIGS. 2, 17 and 18.

As shown, the seal assembly 90-3 of the invention that is incorporated in the filter housing 245 includes the textured surface 248*a*. In some embodiments, the textured surface 248*a* also functions as a seal ring 180 (See FIG. 4) having an inner surface 182 and an outer surface 184 (See FIGS. 4-5). The seal ring 180 functions as described and illustrated in association with FIG. 4. As shown, the inner surface 182 of the sealing ring 180 radially surrounds the exterior rear surface portion 61 (See FIG. 4) of the seal 60. The exterior rear surface portion 61 of the seal surrounds the seal-grasping surface portion 147 of the filter housing 245.

Figure 24:
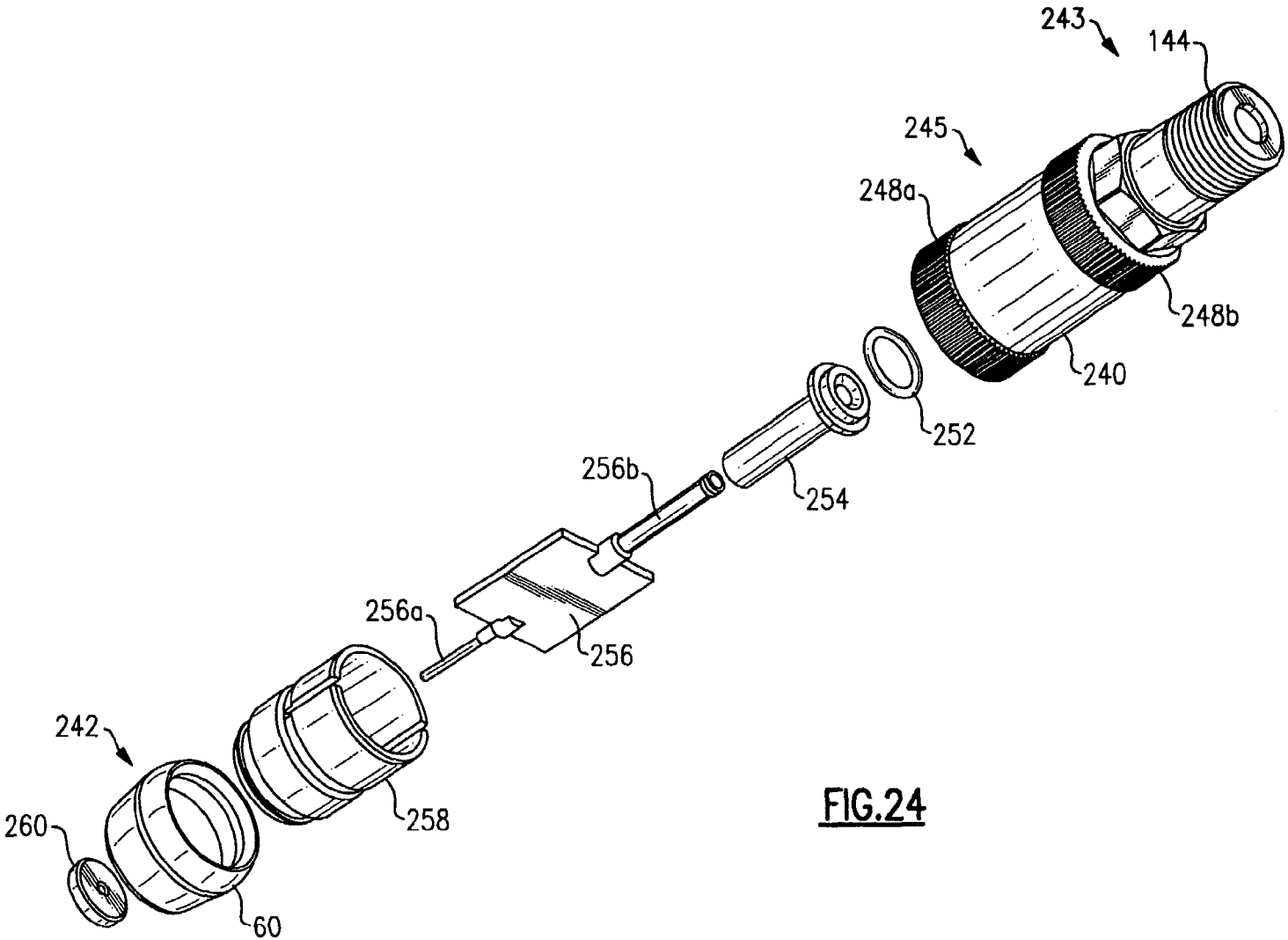
FIG. 24 is an exploded perspective view of contents of the filter housing of FIGS. 22-23.

FIG. 24 is an exploded perspective view of the filter housing of FIGS. 22 and 23. As shown, the filter housing 245 includes textured surfaces 248*a*, 248*b* an outer sleeve 240, an "o ring" 252, an insulated insert body 254, a printed circuit board 256 including a contact pin 256*a* and a collet contact 256*b*, an internally threaded seal grasping component 258, a seal 60 and an electrode insulator component 260.

The "o ring" 252 is typically made of a compressible insulator, such as rubber. The insulated insert body 254 radially surrounds the collet contact 256*b* and provides isolation from the filter housing 245. The printed circuit board (PCB) 256 includes electrical components that collectively process a signal traveling between the first end 242 and the second end 243 of the filter housing 245. Processing of the signal includes filtering and optionally other types of signal conditioning.

As assembled, the contact pin 256*a* is substantially centered (eqi-distant) between the threads of the internally threaded connector 141 (See FIG. 23) which resides within the internally threaded seal grasping component 258. The seal 60 attaches to the internally threaded seal grasping component 258 at the first end 242 of the filter housing 245. The electrode insulator component 260 radially surrounds the contact pin 256*a* of the PCB 256.

Figure 25:
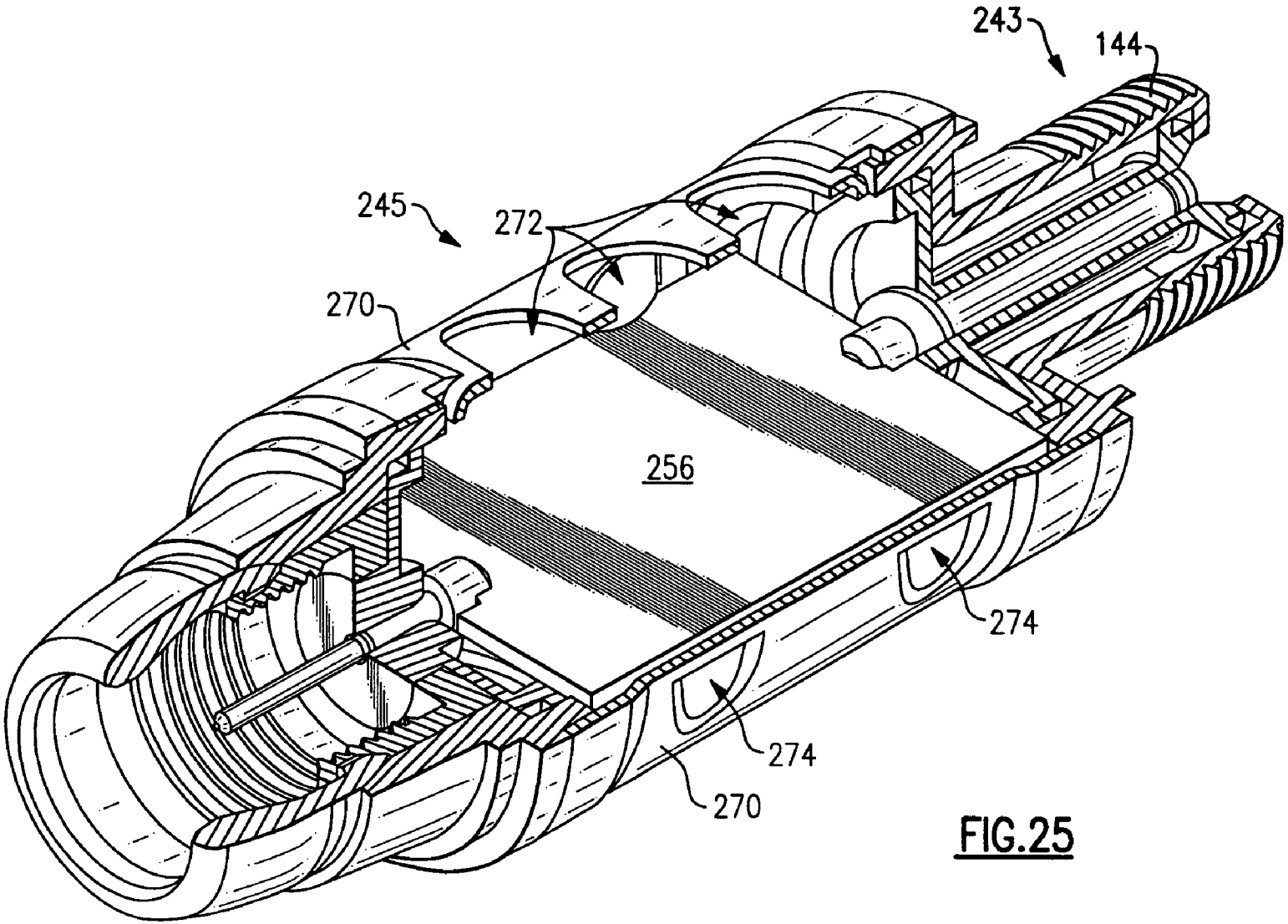
FIG. 25 is a partially cross-sectioned perspective view of the second embodiment of a filter housing of FIGS. 22-24 that excludes the outer sleeve.

FIG. 25 is a partially cross-sectioned perspective view of the second embodiment of a filter housing 245 of FIGS. 22-24 that excludes the outer sleeve 240. As shown, an inner sleeve 270, like the outer sleeve 240, is also typically constructed from a sheet of metal that is shaped to form a cylindrical surface. As shown, the inner sleeve 270 includes a plurality (3) of top openings 272 that provide access to a printed circuit board 256 that is surrounded by the inner sleeve 270.

The inner sleeve 270 also includes a plurality of side openings 274. Each side opening 274 has a straight upper edge that is a folded edge of a folded portion of the inner sleeve that once filled each side opening 274. The folded portion is folded into a cavity (not shown) formed by the inner sleeve 270 and is disposed in a substantially horizontal position (not shown) to form a shelf to support (mount) the PCB 256. The folded portion is also referred to as being "tabbed" into the cavity (not shown) formed by the inner sleeve 270. The shelf formed is also referred to as a "tab".

A person, such as a CATV maintenance person, can insert at least one tool through the top openings 272 to physically access and adjust the operation one or more of the electrical components of the PCB 256. For example, a maintenance person can physically access and tune one or more inductors residing within the PCB 256 via the top openings 272 before incorporating the outer sleeve 270 (See FIGS. 22-24) into the filter housing 245.

In some embodiments, the outer sleeve 270 is rolled at the first end 242 and the second end 243 of the housing over an o-ring (not shown) to surround and seal the PCB 256.

Figure 26A:
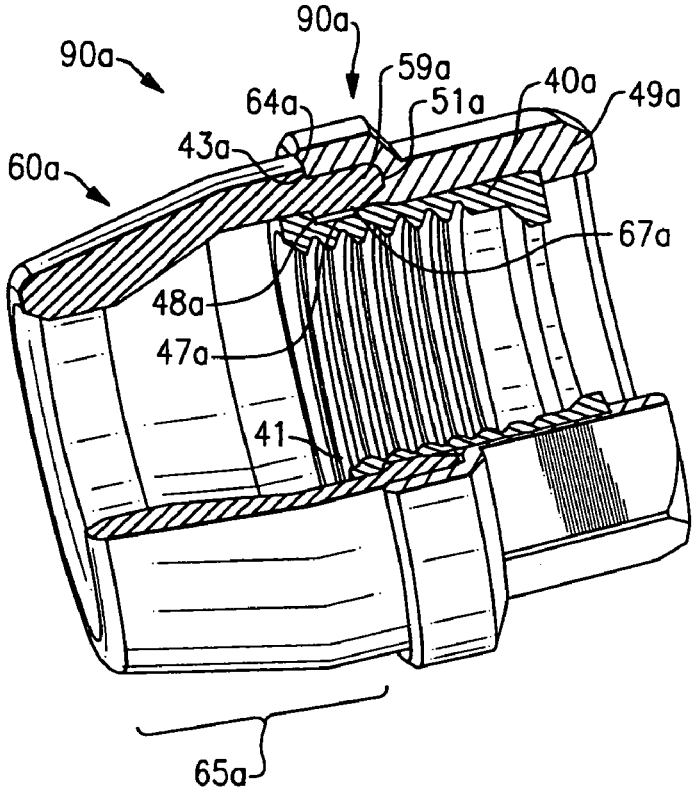
FIG. 26A is a partially cross sectioned perspective view of an embodiment of the nut seal assembly including an internal shoulder.

FIG. 26A is a partially cross sectioned perspective view of an embodiment of the nut seal assembly 90*a* including an internal shoulder 48*a*. A modified nut component 40*a* has an interior surface, at least a portion 41 of which is threaded. A combination of a rear attachment 49*a*, that is configured to surround a portion of the exterior of the nut 40*a*, forms a cavity 51*a* to receive a posterior end 59*a* of an embodiment of a seal 60*a*. A surface along the nut 40*a* and within the cavity 51*a* includes a notch (groove) 47*a* which functions to engage the seal 60*a*. As shown, the notch 47*a* includes a shoulder 48*a* that is suitably sized and shaped to engage in a locking-type interference fit a ridge 67*a* of the posterior end 59*a* of the seal 60*a*.

Upon engagement of the seal 60*a* with the nut 40*a* component, a sealing surface 64*a* of the seal 60*a* abuts an end surface 43 a of the rear attachment 49*a*. The seal 60*a* is shown to have an intermediate section 65*a*. The seal 60*a*, nut 40*a* and rear attachment 49*a* as attached to each other, rotate together and can also rotate together independently of a component (not shown) that is rotatingly attached to a rear side of the rear attachment 49*a*. The rear side of the rear attachment 49*a* is opposite to that of the seal 60*a* which is located on a forward side of the rear attachment 49*a*. This modified embodiment of the seal assembly 90*a* may be substituted for the preferred seal assembly of FIGS. 4 through 9 in the exemplary embodiments incorporating connectors and seal rings as described above.

Figure 26B:
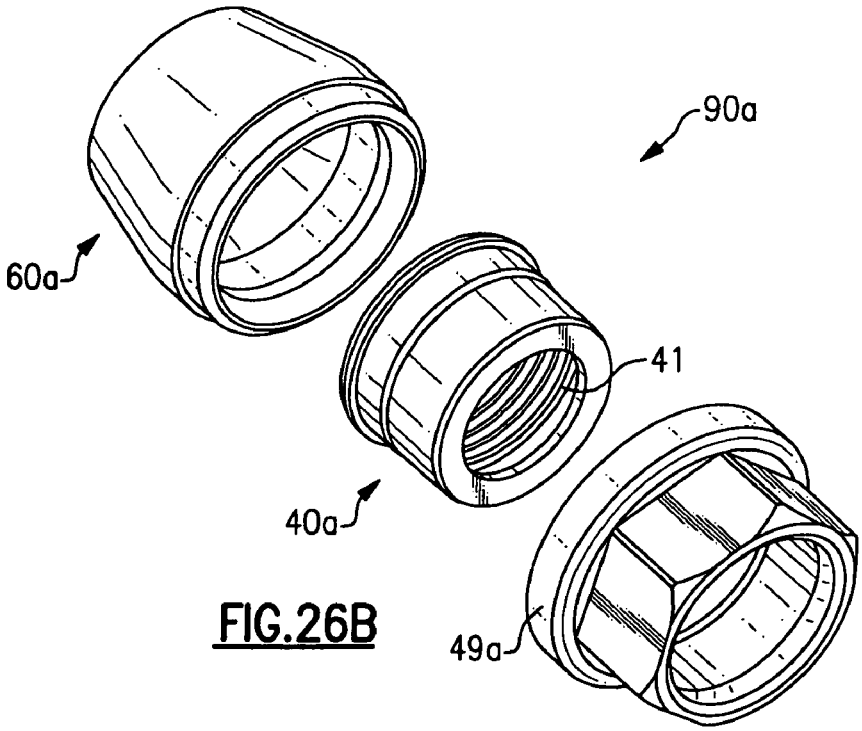
FIG. 26B is a partially cross sectioned exploded perspective view of the embodiment of the nut seal assembly of FIG. 26A.

FIG. 26B is a partially cross sectioned exploded perspective view of the embodiment of the nut seal assembly 90*a* of FIG. 26A. As shown, the nut seal assembly 90*a* includes the seal 60*a*, the modified nut 40*a* and the rear attachment 49*a*. The rear attachment 49*a* is configured to slide over and surround the modified nut 40*a*. The combination of the modified nut 40*a* and a rear attachment 49*a* are configured to receive the seal 60*a* via the cavity 51*a* (See FIG. 26B) formed from the same combination.

Figure 27A:
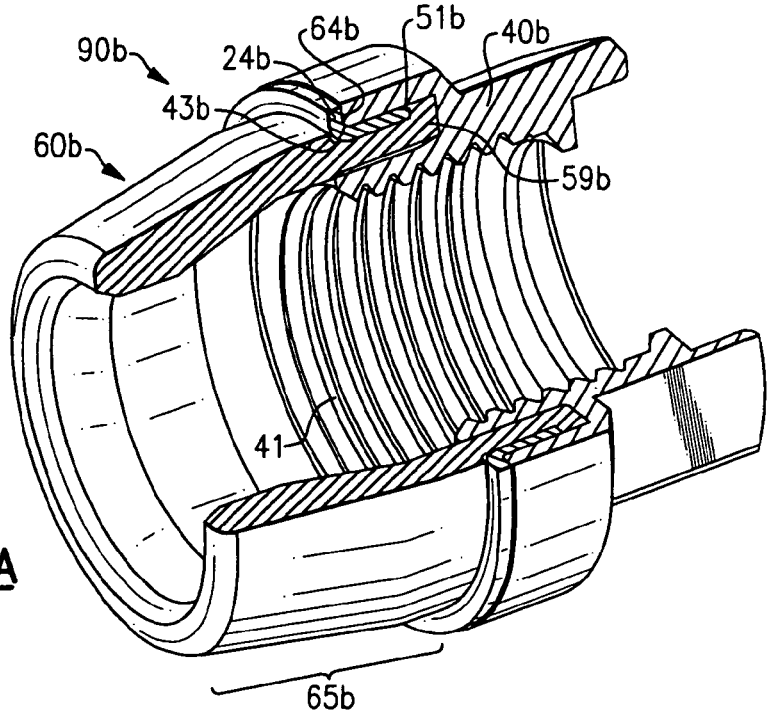
FIG. 27A is a partially cross sectioned perspective view of an embodiment of the nut seal assembly including a compression ring located between a nut body and a seal.

FIG. 27A is a partially cross sectioned perspective view of an embodiment of the nut seal assembly 90*b* including a compression ring 24*b* located between a modified nut 40*b* and a seal 60*b*. A modified nut component 40*b* has an interior surface, at least a portion 41 of which is threaded. A portion of the exterior of the nut 40*b* forms a cavity 51*b* to receive a posterior end 59*b* of an embodiment of a seal 60*b* and a compression ring 24*b*. The compression ring 24*b* is configured to press fit into the cavity 51*b* along with the seal 60*b*.

Upon engagement of the seal 60*b* and the compression ring 24*b* with the nut 40*b* component, a sealing surface 64*b* of the compression ring 24*b* abuts an end surface 43*b* of the nut 40*b*. The seal 60*b* is shown to have an intermediate section 65*b*. The seal 60*b*, nut 40*b* and compression ring 24*b* as attached to each other, rotate together and can also rotate together independently of a component (not shown) that is rotatingly attached to a rear side of the rear attachment 49*a*. The rear side of the rear attachment 49*a* is opposite to that of the seal 60*a* which is located on a forward side of the rear attachment 49*a*. This modified embodiment of the seal assembly 90*b* may be substituted for the preferred seal assembly of FIGS. 4 through 9 in the exemplary embodiments incorporating connectors and seal rings as described above.

Figure 27B:
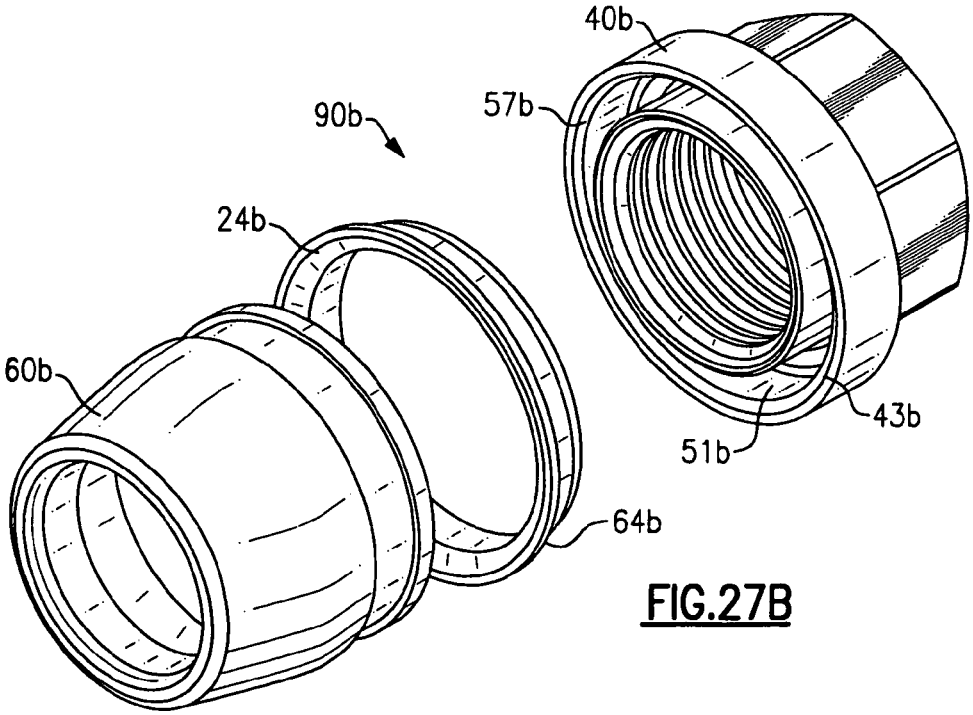
FIG. 27B is a partially cross sectioned exploded perspective view of the embodiment of the nut seal assembly of FIG. 27A.

FIG. 27B is a partially cross sectioned exploded perspective view of the embodiment of the nut seal assembly 90*b* of FIG. 27A. As shown, the nut seal assembly 90*b* includes a seal 60*b*, a modified nut 40*b* and a compression ring 24*b*. The compression ring 24*b* is configured to slide over the nut seal 60*b* and to slide under an outer lip 57*b* of the modified nut 40*b*. The modified nut 40*b* is configured to receive a combination of the seal 60*b* and the compression ring 24*b* via the cavity 51*b* formed from the combination.

While the invention has been described in terms of exemplary embodiments and aspects thereof, and with reference to the accompanying drawings, it will be understood by those skilled in the art that the invention is not limited to the exemplary and illustrative embodiments. Rather, various modifications and the like could be made thereto without departing from the scope of the invention as defined in the appended claims.

We claim:

1. A filter housing comprising;

a housing body defining an internal space for enclosing a printed circuit board, said body having a first end and a second end, said first end including an internally threaded connector, said connector having a seal-grasping surface portion;

a seal having an elastically deformable tubular body attached to the connector, said tubular body having a posterior sealing surface that cooperatively engages the seal-grasping surface portion of the connector, a forward sealing surface that cooperatively engages a threaded port, and an integral joint section between the posterior sealing surface and the forward sealing surface, the integral joint section including a thin portion which is thinner in radial cross-section than at least one of: the posterior sealing surface, and the forward sealing surface;

wherein the thin portion is configured to facilitate radial expansion of the seal upon axial compression.

2. The filter housing of claim 1, wherein at least part of the seal-grasping portion is one of a smooth surface and a roughened surface suitable to frictionally engage the posterior sealing surface of the seal.

3. The filter housing of claim 2, wherein the seal-grasping portion further comprises a ridge on the exterior surface of the connector.

4. The filter housing of claim 1, wherein a posterior sealing surface of the seal is adhered to at least part of the seal-grasping portion of the surface of the connector.

5. The filter housing of claim 1 further comprising a ring engaging the seal radially outward of the posterior sealing surface.

6. The filter housing of claim 5 wherein the ring has an external surface that is knurled.

7. The filter housing of claim 5 wherein the ring has an external flange.

8. The filter housing of claim 1, comprising at least one textured surface that is configured to enable a person to hand grip and rotate said filter housing around a rotational axis.

9. The filter housing of claim 8, comprising an outer surface including flat portions that are configured to enable a person to employ a tool to engage and to rotate said filter housing around said rotational axis.

10. The filter housing of claim 1, comprising an outer surface including flat portions that are configured to enable a person to employ a tool to engage and rotate said filter housing around a rotational axis.

11. The filter housing of claim 1, comprising an inner sleeve that includes at least one opening that is configured to enable a person to access inner portions of said filter housing.

12. The filter housing of claim 11 where said inner portions include a printed circuit board and where said inner sleeve further includes tabbed openings that are configured to provide support for said inner portions of said filter housing.

* * * * *